US011202138B2

(12) United States Patent
Zhao et al.

(10) Patent No.: US 11,202,138 B2
(45) Date of Patent: Dec. 14, 2021

(54) MINIATURE HIGH PERFORMANCE MEMS PIEZOELECTRIC TRANSDUCER FOR IN-EAR APPLICATIONS

(71) Applicant: Facebook Technologies, LLC, Menlo Park, CA (US)

(72) Inventors: Churning Zhao, Redmond, WA (US); Scott Porter, Woodinville, WA (US); Drew Stone Briggs, Seattle, WA (US); Antonio John Miller, Woodinville, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/885,880

(22) Filed: May 28, 2020

(65) Prior Publication Data

US 2021/0281940 A1 Sep. 9, 2021

Related U.S. Application Data

(60) Provisional application No. 62/985,680, filed on Mar. 5, 2020.

(51) Int. Cl.
*H04R 1/10* (2006.01)
*H04R 17/02* (2006.01)

(52) U.S. Cl.
CPC ..... *H04R 1/1016* (2013.01); *H04R 17/02* (2013.01); *H04R 2201/003* (2013.01)

(58) Field of Classification Search
CPC . H04R 1/1016; H04R 17/02; H04R 2201/003
See application file for complete search history.

(56) References Cited

U.S. PATENT DOCUMENTS 9,497,556 B2 * 11/2016 Kaltenbacher ..... H04R 31/003
10,904,671 B2 * 1/2021 Lafort ..... H04R 1/2857
(Continued)

FOREIGN PATENT DOCUMENTS

EP 3531713 A1 8/2019
EP 3672277 A1 6/2020
JP H09252496 A 9/1997

OTHER PUBLICATIONS

Beer, D. et al. "In-Ear Headphone System with Piezoelectric MEMS." 145th AES Convention New York, Convention e-Brief 129, Oct. 17-19, 2018, 1 page.
(Continued)

*Primary Examiner* — Brian Ensey
(74) *Attorney, Agent, or Firm* — Fenwick & West LLP

(57) ABSTRACT

An in-ear device comprises a transducer section, a front volume section, and a rear volume section. The transducer section includes a frame and piezoelectric actuators coupled to the frame. The piezoelectric actuators are configured to generate an acoustic pressure wave. The transducer section includes a first side and a second side, the second side being opposite the first side. The front volume section is coupled to the first side to form a front cavity, the front volume section including an aperture from which the generated acoustic pressure wave exits the front volume section towards an ear drum of a user. The rear volume section is coupled to the second side to form a rear cavity. The transducer section, the front volume section, and the rear volume section are configured to fit entirely within the ear canal.

20 Claims, 16 Drawing Sheets

(56) References Cited

U.S. PATENT DOCUMENTS

| | | | | |
|---|---|---|---|---|
| 2009/0147966 | A1* | 6/2009 | McIntosh | H04R 1/1016 381/71.11 |
| 2011/0048844 | A1* | 3/2011 | Papakyriacou | H04R 1/288 181/151 |
| 2016/0269831 | A1* | 9/2016 | Kappus | H04R 17/005 |
| 2019/0158944 | A1* | 5/2019 | Belonozhko | H04R 1/28 |
| 2020/0100033 | A1* | 3/2020 | Stoppel | H04R 17/00 |

OTHER PUBLICATIONS

Bottoni, F. "What are the Advantages of MEMS Loudspeakers?" LinkedIn, Dec. 21, 2018, 5 pages, [Online], [Retrieved Jun. 25, 2020], Retrieved from the internet <URL:https://www.linkedin.com/pulse/what-advantages-mems-loudspeakers-ferruccio-bottoni/>.

Chen, N. "Specification for Approval: Receive: OWR-05049T-38D." Mar. 2, 2018, pp. 1-7.

Cheng, H-H. et al. "Piezoelectric Microspeaker Using Novel Driving Approach and Electrode Design for Frequency Range Improvement." IEEE MEMS, Jan. 18-22, 2020, pp. 513-516.

USOUND. "Technology." USound.com, 2019, 3 pages, [Online] [Archived on Jul. 24, 2019], Retrieved from the Internet Archive <URL:https://web. archive.org/web/20190724114142/https://www.usound.com/technology/>.

USOUND. "Technology." USound.com, 2020, 3 pages, [Online] [Archived on May 4, 2020], Retrieved from the Internet Archive <https://web.archive.org/web/20200504051425/https://www.usound.com/technology/>.

Vesper. "Technology." Vespermems.com, 2018, 6 pages, [Online] [Archived on Nov. 9, 2018], Retrieved from the Internet Archive <URL:https://web.archive.org/web/20181109052152/https://vespermems.com/technology/>.

Vesper. "Technology." Vespermems.com, 2020, 4 pages, [Online] [Archived on May 13, 2020], Retrieved from the Internet Archive <https://web.archive.org/web/20200513213327/https://vespermems.com/technology/>.

Zhao, C. et al. "Design and Fabrication of a Piezoelectric MEMS Xylophone Transducer with a Flexible Electrical Connection." Sensors and Actuators A: Physical, vol. 275, Jun. 1, 2018, pp. 29-36.

PCT International Search Report and Written Opinion, PCT Application No. PCT/US2021/014823, dated Apr. 20, 2021, 11 pages.

* cited by examiner

200

400
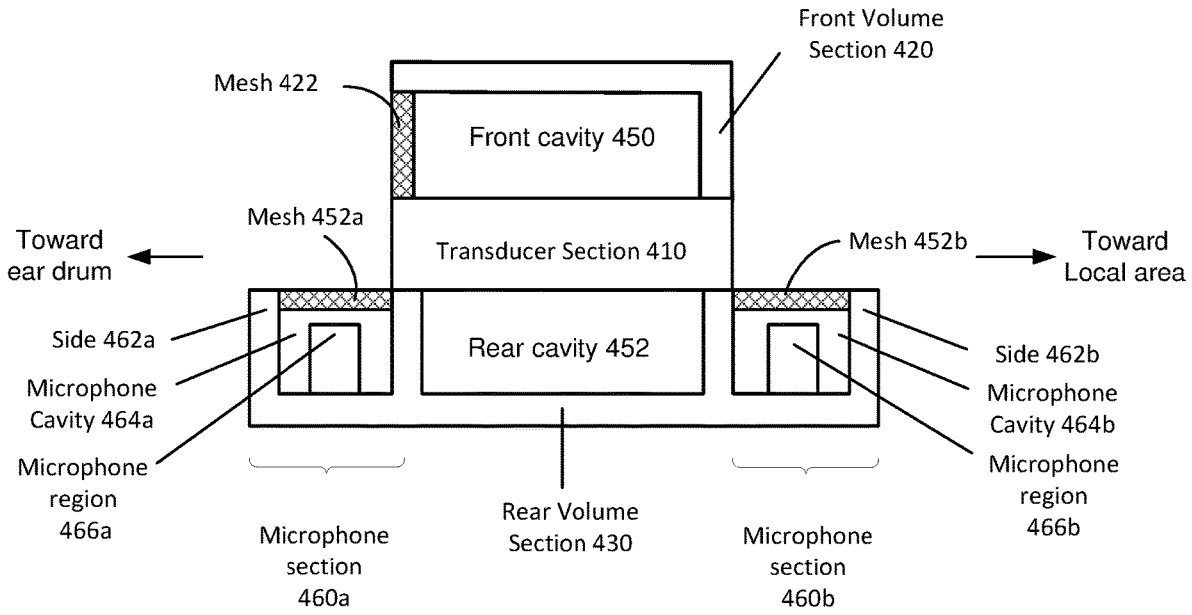
FIG. 4
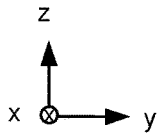

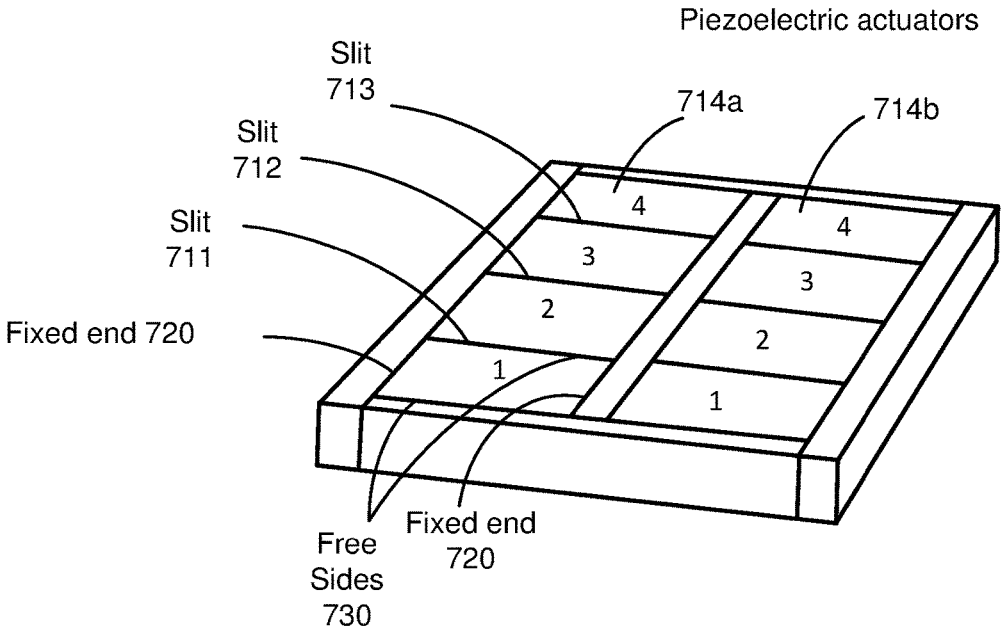
FIG. 7A
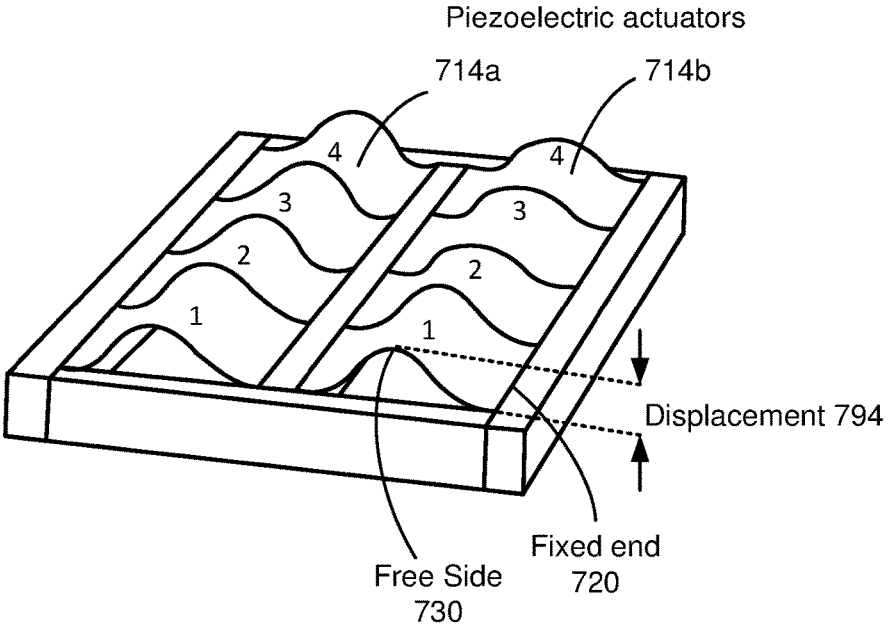
FIG. 7B
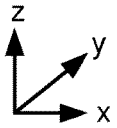

MINIATURE HIGH PERFORMANCE MEMS PIEZOELECTRIC TRANSDUCER FOR IN-EAR APPLICATIONS

CROSS REFERENCE TO RELATED APPLICATION

This application claims the benefit of U.S. Provisional Application No. 62/985,680 filed on Mar. 5, 2020, which is incorporated by reference in its entirety.

BACKGROUND

The present disclosure generally relates to an audio system in a headset (e.g., head mounted display, near-eye display, eyeglasses) or any personal device of the user, and specifically relates to in-ear devices (e.g., all day wearable, sealing in-ear devices).

An ear bud can be used to provide audio content to a user. However, the size of a transducer in an ear bud is a limiting factor for such devices to comfortably fit all ear canal diameters, and traditional dynamic loudspeakers (e.g., with magnet and coil) may be limited in miniaturization. As miniaturization is an issue for components of conventional ear-buds, a large portion of the ear bud is actually located outside of the ear canal (e.g., in the conchal bowl) while being worn by the user.

SUMMARY

An in-ear device includes a transducer section with a frame and piezoelectric actuators coupled to the frame. The piezoelectric actuators generate an acoustic pressure wave. The transducer section includes a first side and a second side, the second side being opposite the first side. A front volume section is coupled to the first side to form a front cavity. The front volume section includes an aperture from which the generated acoustic pressure wave exits the front volume section towards an ear drum of a user. A rear volume section is coupled to the second side to form a rear cavity. The transducer section, the front volume section, and the rear volume section are configured to fit entirely within an ear canal of the user.

BRIEF DESCRIPTION OF THE DRAWINGS

FIG. 4 is an example of a cross sectional view of an in-ear device with two microphone sections, in accordance with one or more embodiments.

FIG. 7A is an example of an isometric view a transducer section with slits in double end clamped piezoelectric actuators of an in-ear device in a first position, in accordance with one or more embodiments.

FIG. 7B is an example of an isometric view of the transducer section of FIG. 7A in a second position, in accordance with one or more embodiments.

DETAILED DESCRIPTION

Figure 1A:
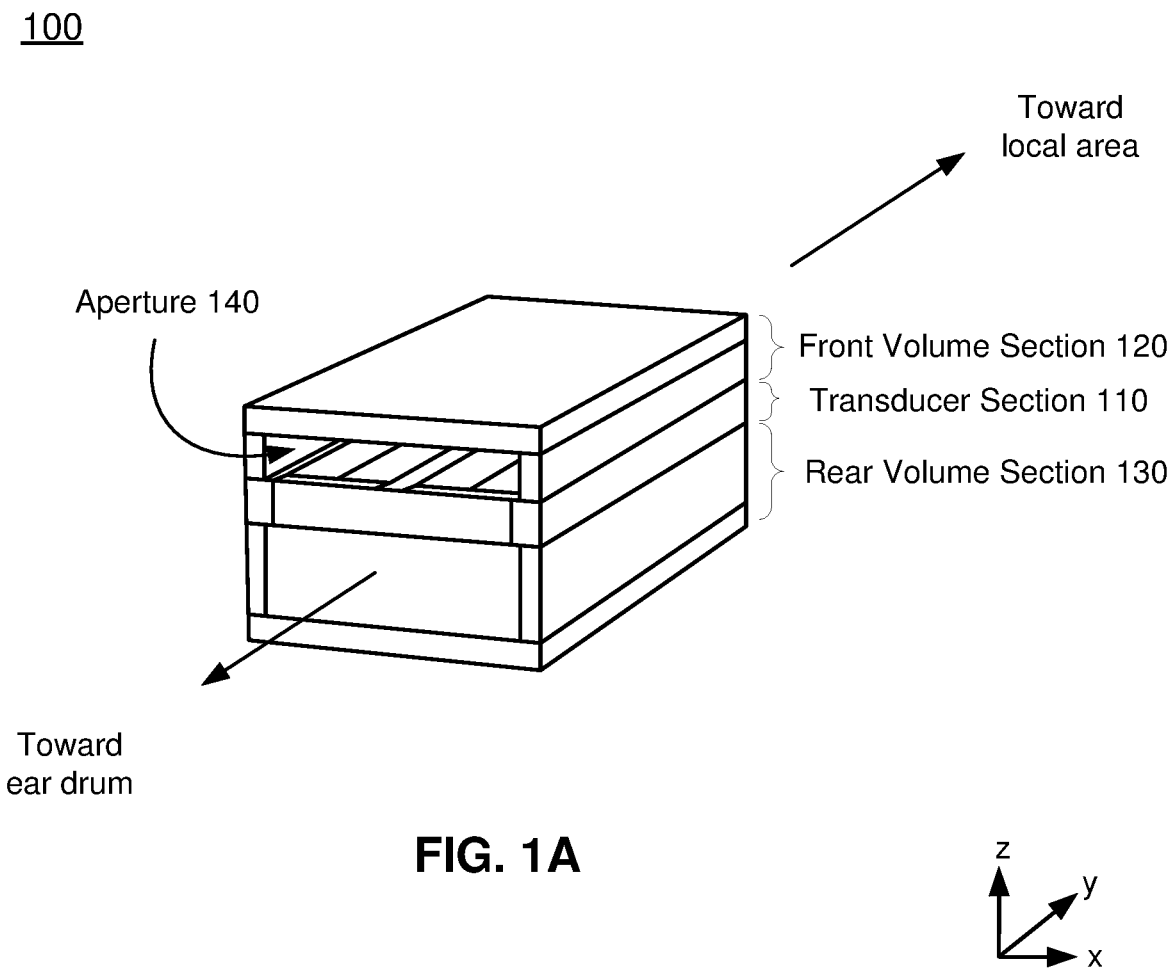
FIG. 1A is an example of an isometric view of an in-ear device, in accordance with one or more embodiments.

Embodiments relate to an in-ear device with piezoelectric actuators to provide sound to a user that is configured to fit entirely within an ear canal of a user. The in-ear device includes a front volume section, one or more transducer sections including the piezoelectric actuators, and one or more rear volume sections. The front volume section, the one or more transducer sections, and the one or more rear volume sections are attached together to form a fully integrated in-ear device. The in-ear device may also include one or more microphone sections to detect sound internal/external to the ear canal used for audio feedback/noise cancellation. The one or more microphone sections may be attached to at least one of the one or more rear volume sections of the in-ear device to form the fully integrated in-ear device. An in-ear device assembly includes the fully integrated in-ear device, a sleeve, and optionally a pin. The sleeve holds the fully integrated in-ear device to provide a close fit to the ear canal of a user. A pin may be attached to the fully integrated in-ear device and/or the sleeve to allow the user to extract the in-ear device from the ear canal or place the in-ear device into the ear canal. At least a portion of the in-ear device assembly is external to the ear canal. In some embodiments, at least a portion of the sleeve or the pin may be external to the ear canal when the in-ear device assembly is worn by the user. In some embodiments, at least a portion of the in-ear device may be external to the ear canal when the in-ear device assembly is worn by the user. While a dimension of the in-ear device corresponding to a width of the ear canal is smaller than the width of the ear canal so that the in-ear device can fit entirely inside the ear canal of the user, a portion of the in-ear device may be external to the ear canal when worn by the user.

Advantages of the in-ear device over a conventional dynamic loudspeaker can include a reduction in size, a reduction in weight, an improvement in power efficiency, an improvement in impulse response, an improvement in durability, and an ability to provide full band audio content. The in-ear device with piezoelectric actuators eliminates the use of magnets and a coil of a conventional dynamic loudspeaker, allowing for the reduction in size, reduction in weight, and improvement in power efficiency. In contrast to a conventional loudspeaker that is round in shape, the piezoelectric actuators of the in-ear device have a high aspect ratio which enable a shape of the in-ear device to better fit inside the ear canal of the user which is long and narrow shape. The high aspect ratio of the piezoelectric actuators can be selected to move a resonance frequency of the piezoelectric actuators outside of a main band of human hearing so that the piezoelectric actuators can provide a flat response in the full band audio content. In contrast, a conventional loudspeaker has a resonance within the audio band (20 Hz-20 k Hz) which results in a non-flat response. Sometimes, two or more speakers are used to cover the full audio band, one to provide for lower frequencies and one to provide for higher frequencies in the main band of human hearing. The in-ear device may be fabricated using a micro-electro-mechanical system (MEMS) process technology to enable a reduction in size and the use of piezoelectric ceramic may enable improvements in durability. Use of MEMS process technology has advantages in manufacturing such as high precision and high repeatability. The use of piezoelectric ceramic as the active moving element has the material strength advantage over the traditional diaphragm, which often is plastic. Therefore, this device is more durable and more linear, compared to the traditional speakers. The piezoelectric actuators may be cantilever bimorphs with low mass and high stiffness, which as the active moving element, improves the impulse response of the piezoelectric actuators to provide higher performance active noise control over a conventional dynamic loudspeaker.

The term MEMS process technology refers to a process technology used to manufacture devices that include mechanical and electrical components that can be micrometers in size. MEMS process technology may be silicon-based, and produced using microfabrication processes developed for integrated circuits (ICs). The devices manufactured by MEMS process technology may be 3D structures which involve mechanical movement of components.

In-Ear Device with a Single Transducer Section

FIG. 1A an example of an isometric view of an in-ear device 100, in accordance with one or more embodiments. The in-ear device 100 includes a transducer section 110, a front volume section 120, and a rear volume section 130. An aperture 140 is included in the front volume section 120 of the in-ear device. When the in-ear device 100 is worn by a user, a side of the in-ear device 100 including the aperture 140 faces a direction towards an ear drum of the user, and a side of the in-ear device 100 opposite the side of the in-ear device 100 including the aperture 140 faces a direction towards a local area external to the ear canal. The transducer section 110 is configured to provide an acoustic pressure wave (e.g., audio content, active noise cancellation, etc.) to the user by pushing air against the front volume section 120 and the rear volume section 130. The acoustic pressure waves produced by the transducer section 110 exit the front volume section 120 through the aperture 140 to provide sound to the user via an ear canal of the user (e.g., toward the ear drum). The rear-volume section 130 may be configured attenuate an out-of-phase acoustic pressure wave produced by the transducer section 110. The rear volume section 130 may also be configured to enhance the sound from the speaker. The front volume section 120 and rear volume section 130 are selected to increase or maximize the energy transduction efficiency and sound pressure level output. A volume of the rear volume section 130 may be larger than a volume of the front volume section 120.

Figure 1B:
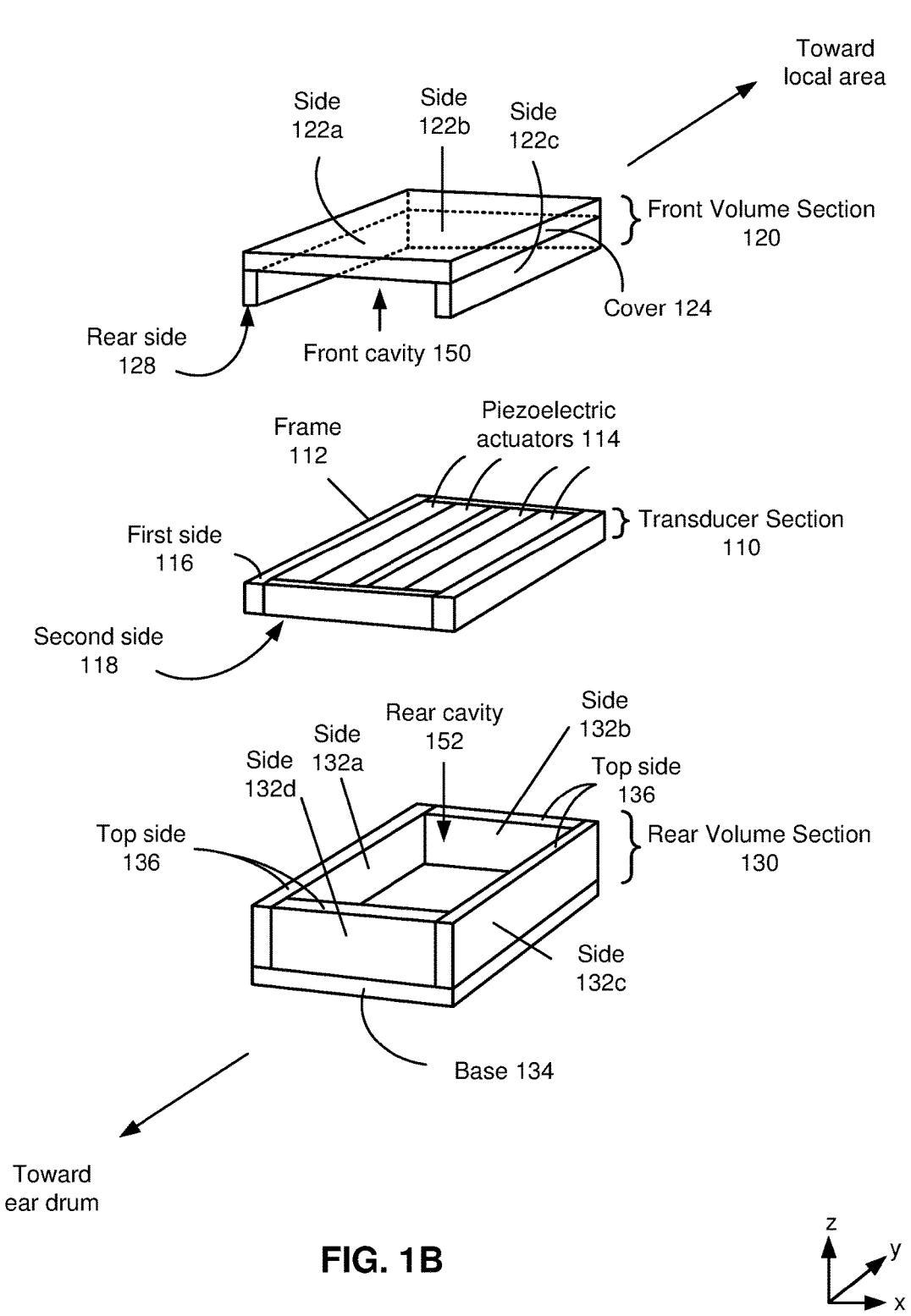
FIG. 1B is an example of an exploded view of the in-ear device of FIG. 1A.

FIG. 1B is an example of an exploded view of the in-ear device 100 of FIG. 1A. The transducer section 110 includes a frame 112 and a plurality of piezoelectric actuators 114 coupled to the frame 112. A first side 116 of the transducer section 110 is coupled to a rear side 128 of the front volume section 120 to generate a front cavity 150. A second side 118 of the transducer section 110 that is opposite the first side 116 of the transducer section 110 is coupled to the top side 136 of the rear volume section 130 to generate a rear cavity 152. A volume of the rear cavity 152 may be larger than a volume of the front cavity 150. The volume of the rear cavity 152 is large enough so that its acoustic compliance is not dominant, compared to the acoustic compliance of the piezoelectric actuators or the front cavity. The acoustic compliance that dominates is the acoustic compliance that is smallest. The volume of the rear cavity 152 can be selected so that the acoustic compliance of the rear cavity is not smaller than the acoustic compliance of the piezoelectric actuators or the acoustic compliance of the front cavity.

The front volume section 120 includes three sides 122 and a cover 124. The three sides 122 includes a first side 122*a*, a second side 122*b*, and a third side 122*c*. The first side 122*a* and the third side 122*c* are separated from each other (e.g., missing a fourth side) to form the aperture 140 (e.g., shown in FIG. 1A). The height of front cavity 150 can range from 100-500 μm. A rear side 128 of the front volume section 120 includes the bottom surfaces of the three sides 122. The rear side 128 of the front volume section 120 is coupled to the first side 116 of the transducer section 110 to form the front cavity 150. A mesh may be provided to cover the aperture 140 of the front volume section 120. The mesh allows the acoustic pressure waves produced by the transducer section 110 to pass through the aperture 140 of the front volume section 120 while protecting the transducer section 110 from liquid and particle ingress. The mesh may be made of woven polyester monofilament with different pore size to ensure the protection and to allow the produced acoustic pressure waves to pass through at desired frequencies. In other embodiments, the front volume section 120 may include a different number of sides 122 (e.g., one or more sides). In other embodiments, the aperture 140 may be a portion of a side 122 (e.g., a hole or missing section of a side 122).

The rear volume section 130 includes four sides 132 and a base 134. The four sides 132 include a first side 132*a*, a second side 132*b*, a third side 132*c*, and a fourth side 132*d*. The top side 136 of the rear volume section 130 includes top surfaces of the four sides 132. In some embodiments, a rear port with resistive mesh may be used, if the rear volume is not big enough. The resistive mesh has a more damping effect than a mesh covering the front volume section 120. The resistive mesh may function to absorb sound instead of allowing sound to pass through. The rear port may be an aperture on a side of the rear volume section 130 of the in-ear device 100 that is facing the local area external to the ear canal. In some embodiments, acoustic material with small porous particles may be used to fill in the rear volume section 130 to increase an effective acoustic volume. In other embodiments, the rear volume section 130 may include a different number of sides 132 (e.g., one or more sides).

The transducer section 110, the front volume section 120, and the rear volume section 130 can be separately manufactured with MEMS process technology, and subsequently bonded and/or packaged together to form a fully integrated in-ear device 100. The whole manufacturing process may be compatible with Complementary Metal Oxide Semiconductor (CMOS) processing to leverage semiconductor manufacturing process for good precision and cheap cost. In some embodiments, a front volume section 120 and/or a rear volume section 130 may be separately manufactured or fabricated using printed circuit board (PCB) technology or other packaging technology, and then bonded and/or packaged with the transducer section 110 that is fabricated with MEMS process technology to form the fully integrated in-ear device 100.

Figure 1C:
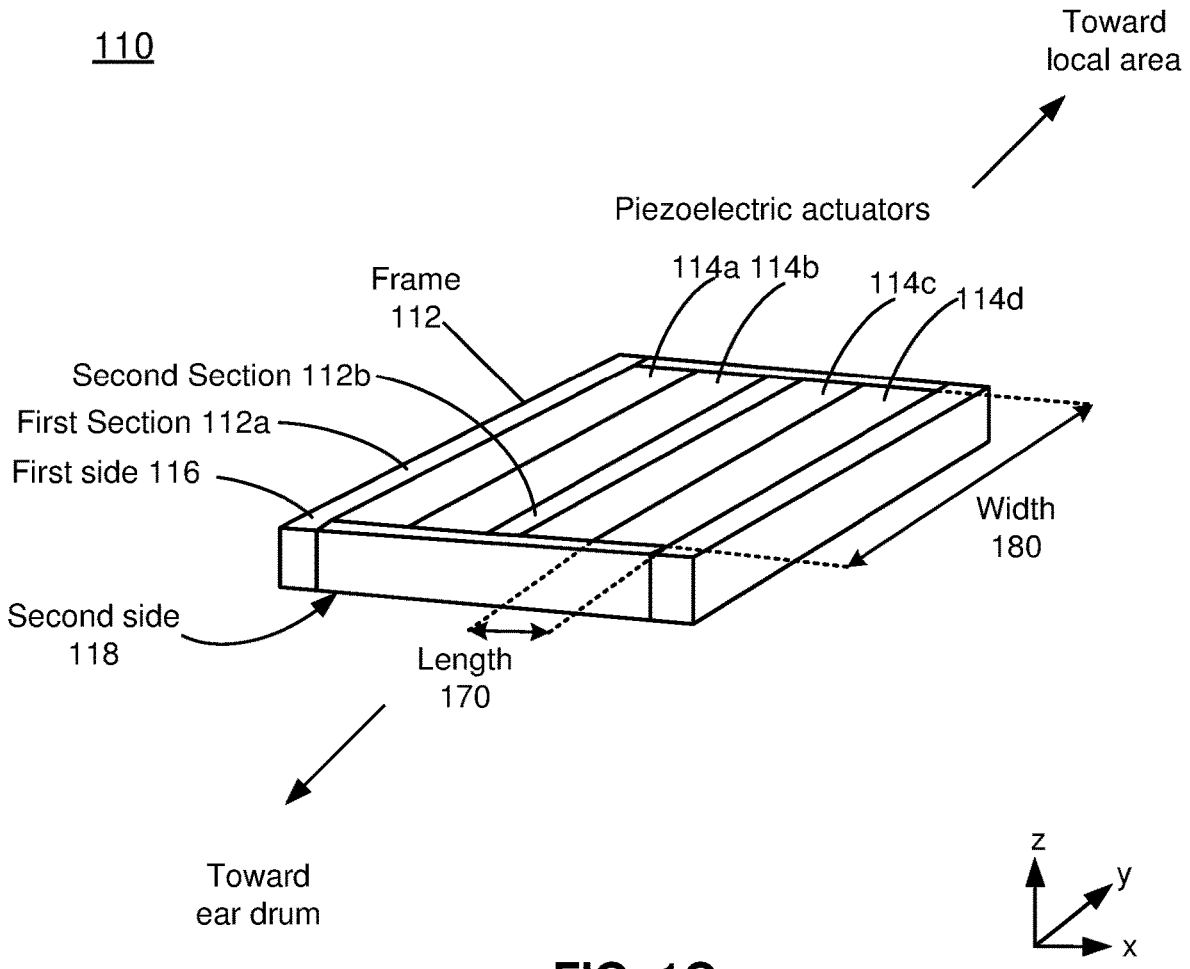
FIG. 1C is an example of an isometric view of a transducer section of the in-ear device of FIG. 1A in a first position.

FIG. 1C is an example of an isometric view of the transducer section 110 of the in-ear device 100 of FIG. 1A in a first position. In the first position, a first side 116 of the transducer section 110 includes a first surface of the piezoelectric actuators 114 and a first surface of the frame 112 that are in or around a same plane. A first pair of piezoelectric actuators includes first and second piezoelectric actuators 114*a* and 114*b*. Between 114*a* and 114*b*, there is a tiny gap, which may be smaller than 1 μm. A second pair of piezoelectric actuators includes third and fourth piezoelectric actuators 114*c* and 114*d*. Each of the piezoelectric actuators 114 have a width 180 that is larger than a length 170 of the piezoelectric actuators 114. The length 170 of the piezoelectric actuators 114 corresponds to a distance between a first end and a second end of the piezoelectric actuators 114. The width 180 of the piezoelectric actuators 114 corresponds to a distance across the second end in a dimension in-line with the ear canal. The frame 112 includes a first section 112*a* and a second section 112*b*. The first section 112*a* is an external portion of the frame 112 that surrounds both pairs of the piezoelectric actuators 114. The first section 112*a* of the frame 112 is coupled to the front volume section 120 and the rear volume section 130. The second section 112*b* is an internal portion of the frame 112 which separates the first and second pairs of the piezoelectric actuators 114.

Figure 1D:
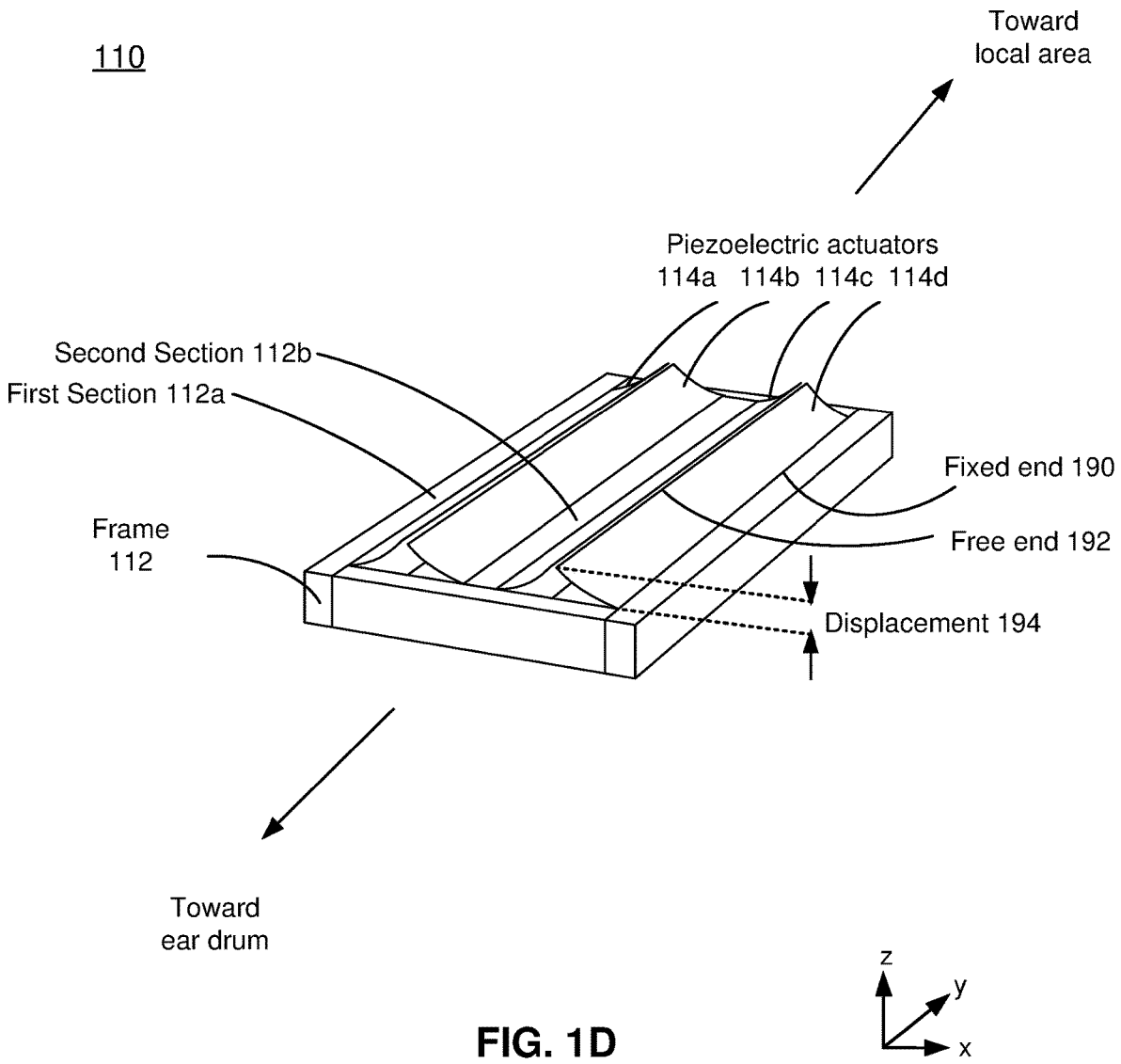
FIG. 1D is an example of an isometric view of the transducer section of FIG. 1C in a second position.

FIG. 1D is an example of an isometric view of the transducer section 110 of FIG. 1C in a second position. The piezoelectric actuators 114 each have a fixed end 190 (e.g., first end) and a free end 192 (e.g., second end) opposite the fixed end 190. In the second position, the free end 192 of the piezoelectric actuators 114 is displaced in a direction towards the front volume section 120 of the in-ear device 100. The fixed ends 190 of the first and fourth piezoelectric actuators 114*a* and 114*d* are coupled to portions of the first section 112*a* of the frame 112, and the fixed ends 190 of the second and third piezoelectric actuators 114*b* and 114*c* are coupled to portions of the second section 112*b* of the frame 112. The free ends 192 of the first and second piezoelectric actuators 114*a* and 114*b* face each other. The free ends 192 of the third and fourth piezoelectric actuators 114*c* and 114*d* face each other. In the second position, a height of a free end (e.g., the free end 192 of the piezoelectric actuator 114*d*) of a piezoelectric actuator has a displacement 194 relative to a height of a fixed end of the piezoelectric actuator (e.g., the fixed end 190 of the piezoelectric actuator 114*d*).

Note that as illustrated the piezoelectric actuators 114 are all actuated to have their respective free ends displaced at a same amount relative to their corresponding fixed ends. In some embodiments, some or all of the piezoelectric actuators 114 may be actuated independently. Accordingly, an amount of displacement may vary as a function of time for different free ends. For example, at a same time value, an amount of displacement of the free end 192 of the piezoelectric actuator 114*a* may be different than an amount of displacement of the piezoelectric actuator 114*b*.

In some embodiments, the frame 112 may be made from a non-conductive material (e.g., plastic, glass, silicon). On top of the frame 112, there are some thin conductive traces and pads (copper, gold, aluminum, etc.) for electrical conduction. The thickness of these traces can be 10-1000 nm. A thickness of the frame 112 is greater than a thickness of the piezoelectric actuators 114. The thickness of the frame can be 100-600 μm.

The piezoelectric actuators 114 are made of piezoelectric materials (e.g., piezoelectric ceramics) that can produce a physical displacement in response to an applied electric field. The piezoelectric material may be aluminum nitride (AlN), scandium doped aluminum nitride (AlScN), zinc oxide (ZnO), lead zirconate titanate (PZT), etc. In some embodiments, the piezoelectric actuators 114 are made of AlN or AlScN, and the in-ear device 100 does not require a direct current (DC) voltage bias to drive the piezoelectric actuators 114, which can simplify a corresponding electronic circuit for activating the piezoelectric actuators 114. The low material loss of the AlN or AlScN can improve power efficiency of the in-ear device 100.

The piezoelectric actuators 114 may be bimorphs, cantilevers that include two layers of piezoelectric materials. When a voltage is applied to drive or activate the bimorph, the applied voltage causes a first piezoelectric layer to expand (e.g., push) and a second piezoelectric layer to contract (e.g., pull), causing the cantilever to extend further than it normally would in comparison to a cantilever with a single layer of piezoelectric material. Use of a bimorph as piezoelectric actuators 114 enables larger volume displacement. The thicknesses of the first and second piezoelectric layers of the bimorph can be the same for increased performance. The total thickness of the bimorph can be 0.5-4 μm. The two layers of the piezoelectric material are sandwiched by three thin electrodes, which can be platinum (Pt) or molybdenum (Mo). The metal-piezo-metal-piezo-metal stack forms the bimorph. The metal layers are connected electrically through the traces to the pads on the frame 112 for electrical connection.

Electrodes may be formed to contact the piezoelectric actuators 114 so that the piezoelectric actuators 114 can be driven by an applied voltage. The pads are placed on top of the frame 112, and they are connected through thin traces connecting to the metal layers on the bimorphs. A controller may apply a voltage from a power supply to the piezoelectric actuators 114 via the electrodes to activate the piezoelectric actuators 114.

Having multiple piezoelectric actuators 114 in the transducer section 110 allow for an increase in an actuator area, which increases the volume displacement of air for better performance of the in-ear device 100. The four piezoelectric actuators 114 move together (in phase) to generate the acoustic pressure wave. In other embodiments, there could be a different number of piezoelectric actuators 114.

The piezoelectric actuators 114 of the transducer section 110 have a high aspect ratio (e.g., width 180 to length 170 ratio). The length 170 of each piezoelectric actuator 114 is relatively short compared to the width 180 of the piezoelectric actuator 114. A high aspect ratio of the piezoelectric actuators 114 enables the in-ear device 100 to better fit in the ear canal, which is constrained by width of the ear canal. In this example, the width of the piezoelectric actuators 114 corresponds to a dimension that is in-line with the ear canal, and the length of the piezoelectric actuators 114 corresponds to a dimension across the ear canal (e.g., width of ear canal). A high aspect ratio of the piezoelectric actuators may also enable the resonance frequency 210 of the piezoelectric actuator to be outside of a main band of human hearing (e.g., above 20 kHz). The piezoelectric actuators 114 may have a resonance frequency above 20 kHz. Given a particular width 180, decreasing the length of the piezoelectric actuator 114 can increase a frequency response of the piezoelectric actuators 114 to improve active noise cancellation. Given a particular length 170, increasing the width 180 of the piezoelectric actuators 114 enables the maximum displacement of the piezoelectric actuators 114 (e.g., height of the free end 192 to a height of a fixed end 190 of a piezoelectric actuator) to be distributed over the free end 192 which allows operation within a constrained thickness (e.g., width of ear canal) more effectively. Increasing the width 180 of the piezoelectric actuators 114 can enable maintaining a larger surface area in view of the short length 170 so that the piezoelectric actuators 114 can move a relatively large volume of air for a given displacement 194, resulting in better performance in a constrained package.

Figure 2:
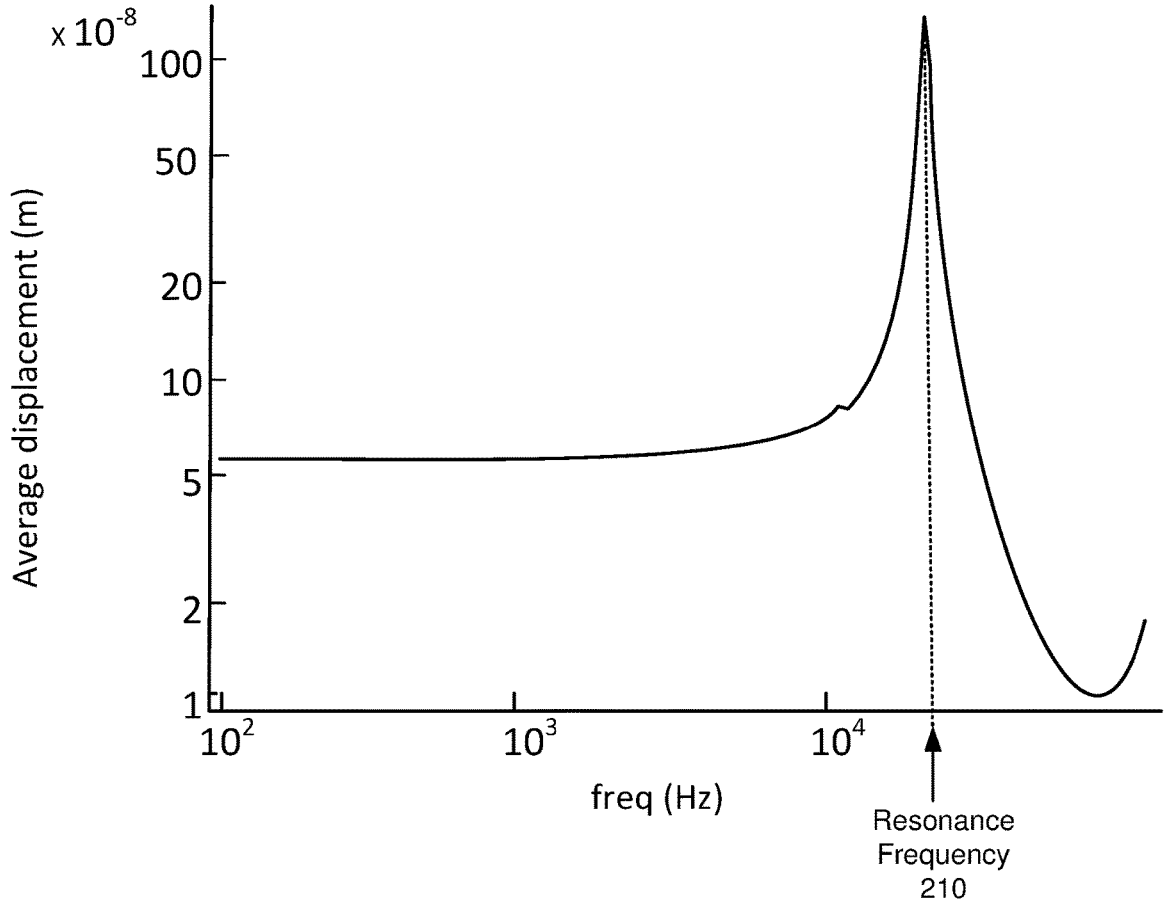
FIG. 2 is an example of graph showing, for constant voltage actuation, an average displacement of a piezoelectric actuator as a function of frequency, in accordance with one or more embodiments.

FIG. 2 is an example of graph 200 showing, for constant voltage actuation, an average displacement of a piezoelectric actuator as a function of frequency, in accordance with one or more embodiments. The average displacement may be an average of deflections along a whole vibrating surface of a piezoelectric actuator (e.g., average of displacements of the heights of a piezoelectric actuator along a whole vibrating surface relative to a height of a fixed end of the piezoelectric actuator). A peak in the average displacement of the piezoelectric actuator occurs at a resonance frequency 210. The resonance frequency 210 is higher than 10 kHz and is around or higher than 20 kHz. The sharp peak in the resonance can be attenuated from a low pass filter. A high aspect ratio of the piezoelectric actuators can be selected to move the resonance frequency 210 of the piezoelectric actuator outside of a main band of human hearing (e.g., above 20 kHz). The high aspect ratio can enable the piezoelectric actuators to produce acoustic pressure waves (e.g., provide audio) over a full audible range (e.g. 20-20,000 Hz) with high fidelity instead of having different actuators to cover the audible range (e.g., one for a range of frequencies above a resonance frequency, and one for a range of frequencies below a resonance frequency), which can also decrease the overall size of the in-ear device 100.

In-Ear Device with Two Transducer Sections

Figure 3:
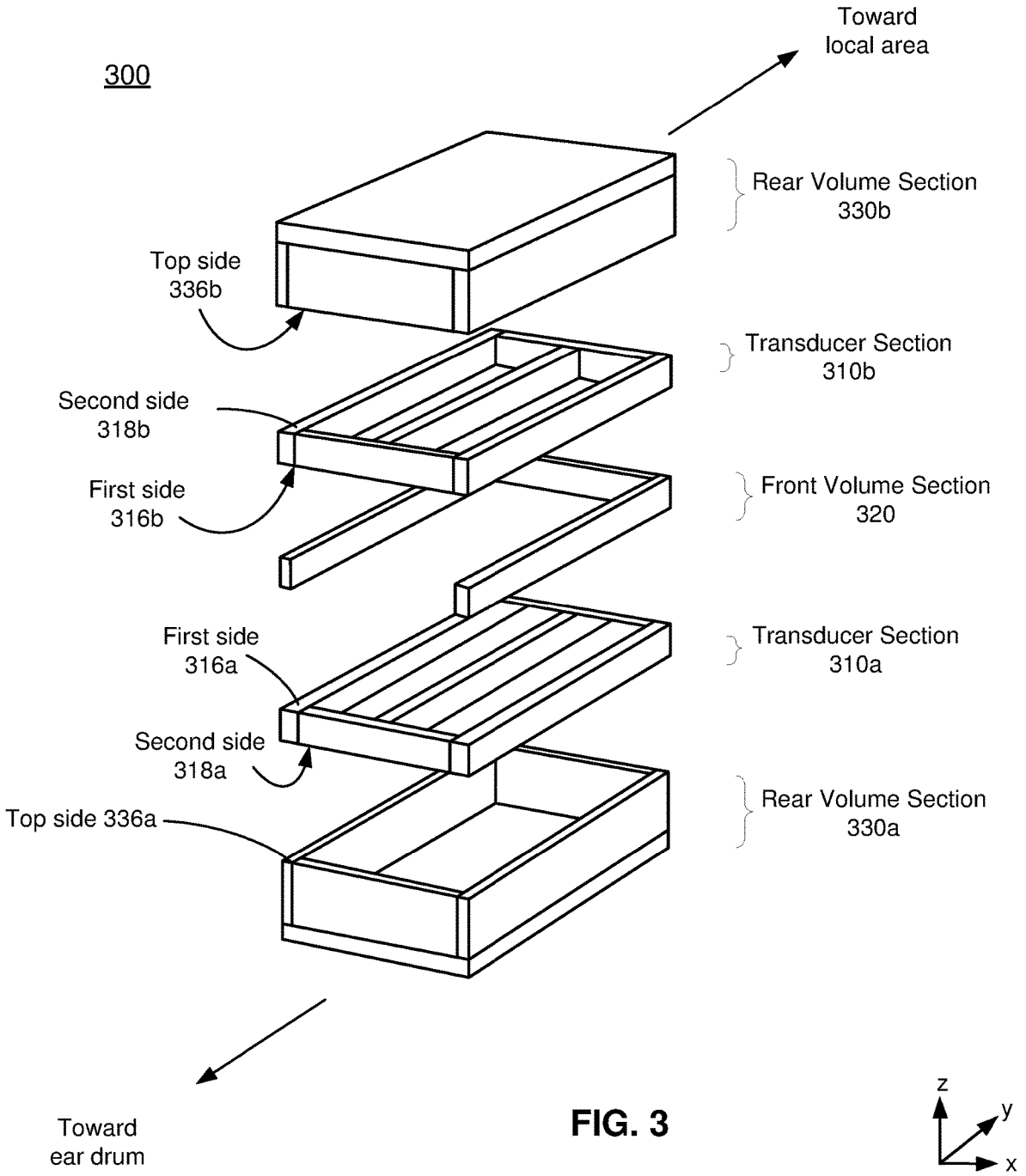
FIG. 3 is an example of an exploded view of an in-ear device with two transducer sections, in accordance with one or more embodiments.

FIG. 3 is an example of an exploded view of an in-ear device 300 with two transducer sections 310, in accordance with one or more embodiments. The in-ear device 300 includes a first transducer section 310*a*, a second transducer section 310*b*, a front volume section 320, a first rear volume section 330*a*, and a second rear volume section 330*b*.

The front volume section 320 is similar to the front volume section 120 except that it does not include a cover. The first transducer sections 310*a* and 310*b* are the same as the first transducer section 110. A side of the front volume section 320 is attached to a first side 316*a* of a first transducer section 310*a*, and an opposite side of the front volume section 320 is attached to a first side 316*b* of the second transducer section 310*b* to generate a front cavity. Rear volume sections 330*a* and 330*b* are the same as the rear volume section 130. A second side 318*a* of first transducer section 310*a* is coupled to a top side 336*a* of the rear volume section 330*a* to generate a first rear cavity. A second side 318*b* of second transducer section 310*b* is coupled to the top side 336*b* of the rear volume section 330*b* to generate a second rear cavity.

The piezoelectric actuators in the transducer sections 310 are shown in a first position similar to the first position for the transducer section 110 of FIG. 1C. When the transducer sections 310 are in a second position, a free end of the piezoelectric actuators are displaced in a direction towards the front volume section 320 of the in-ear device 300.

Once the piezoelectric actuators of the first and second transducer sections 310*a* and 310*b* are activated, the piezoelectric actuators push air against the front volume section 320 and first and second rear volume sections 330*a* and 330*b* of the in-ear device 300. A first acoustic pressure wave may be produced by the first transducer section 310*a*, and a second acoustic pressure wave may be produced by the second transducer section 310*b*. In some embodiments, each of the piezoelectric actuators of the first transducer section 310*a* and/or the second transducer section 310*b* may be actuated independent from one another. For example, a single piezoelectric actuator of the first transducer section 310*a* may be actuated while the remaining piezoelectric actuators of the first transducer section 310*a* and the second transducer section 310*b* are not actuated. In some embodiments, the piezoelectric actuators of the first and second transducer sections 310*a* and 310*b* may move together (in phase) to generate the acoustic pressure wave (e.g., the first and second acoustic pressure wave). The audio (acoustic pressure wave) produced from the transducer section 310*a* exits the in-ear device 300 through the aperture in the front volume section 320 to provide sound to a user via an ear canal of the user. The rear volume sections 330*a* and 330*b* may be used to attenuate an out-of-phase acoustic pressure wave that is produced by the first and second transducer sections 310*a* and 310*b*. The front volume section 320 and the first and second rear volume sections 330*a* and 330*b* may be selected to increase or maximize the energy transduction efficiency and sound pressure level output. This embodiment with two transducer sections will double the acoustic output while sharing the same front cavity, compared to the embodiment with a single transducer section.

In-Ear Device with Two Microphone Sections

FIG. 4 is an example of a cross sectional view of an in-ear device 400 with two microphone sections 460, in accordance with one or more embodiments. The two microphone sections 460 include a first microphone section 460*a* to capture sound internal to an ear canal of a user and a second microphone section 460*b* to capture sound external to the ear canal of the user. The in-ear device 400 is similar to the in-ear device 100 of FIG. 1A except it includes a mesh 422 and the two microphone sections 460. In other embodiments, the in-ear device 400 may be similar to the in-ear device 300 of FIG. 3 except that includes the two microphone sections 460. In other embodiments, there may be only one microphone section (e.g., first microphone section 460*a* or second microphone section 460*b*).

The in-ear device 400 includes a transducer section 410, a front volume section 420, and a rear volume section 430 that are similar to the transducer section 110, front volume section 120, and rear volume section 130 of the in-ear device 100. A front cavity 450 is formed in the front volume section 420, and a rear cavity 452 is formed in the rear volume section 430. A mesh 422 covers an aperture of the front volume section 420. The mesh 422 allows acoustic pressure waves to pass through the aperture of the front volume section 420 while protecting the transducer section 410 from liquid and particle ingress. The mesh 422 may be made of woven polyester monofilament with different pore size to ensure the protection and acoustic pressure waves to pass through at the desired frequencies. In other embodiments, there may not be a mesh 422. When the in-ear device 400 is worn by a user, a side of the in-ear device 400 including the mesh 422 covering the aperture of the front volume section 420 faces a direction towards an ear drum of the user, and a side opposite to the side of the in-ear device 400 including the mesh 422 faces a direction towards a local area external to the ear canal of the user.

The first microphone section 460*a* is positioned on a same side as an aperture (e.g., covered by the mesh 442) of the front volume section 420 of the in-ear device 400 (e.g., side of the in-ear device providing sound to the user) to capture sound internal to the ear canal. The first microphone section 460*a* includes one or more sides 462*a* coupled to a side of the rear volume section 430 to form a microphone cavity 464*a*. An aperture of the first microphone section 460*a* is in a top surface of the microphone section 460*a*. The aperture of the first microphone section 460*a* is covered by a mesh 452*a*. The mesh 452*a* allows acoustic pressure waves to pass through the aperture of microphone section while protecting the microphone 460 from liquid and particle ingress. The mesh 452*a* may be made of woven polyester monofilament with different pore size to ensure the protection and acoustic pressure waves to pass through at the desired frequencies. In other embodiments, there may not be a mesh 452*a* covering the aperture of the microphone section 460*a*. In other embodiments, the aperture may be in a portion of a surface or in a different surface of the microphone section 460*a*. The first microphone section 460*a* includes a microphone region 466*a* which includes one or more microphones to detect sound. The one or more microphones may be a MEMS microphone chip or a microphone array. The microphone array may be used to detect a direction of the sound (e.g., source direction). The one or more microphones may be configured to receive a gain signal to scale a detected signal from the one or more microphones based on the instructions provided to the microphone. For example, a gain of the one or more microphones may be adjusted to avoid clipping of the detected signal or for improving a signal to noise ratio in the detected signal. The sound captured from the microphone region 466*a* be used for audio feedback to improve the sound quality of the audio provided to the user. For example, the captured sound may be compared to a target sound and used to adjust transducer instructions provided to the transducer section 410 to generate a sound pressure wave that is more similar to the target sound, to mitigate the occlusion effect introduced by the blocked ear canal. Also, the microphone signals can be used for feedback active noise cancelling.

The second microphone section 460*b* is similar to the first microphone section 460*a* except it is positioned on a side opposite the side including the aperture (e.g., mesh 422) of the front volume section 420 of the in-ear device 400 (e.g., side which faces away from the side providing sound to the user) to capture sound external to the ear canal. The second microphone section 460*b* includes one or more sides 462*b* coupled to another side of the rear volume section 430 to form a microphone cavity 464*b*. An aperture of the first microphone section 460*b* is in a top surface of the microphone section 460*b* covered by a mesh 452*b*. The sound captured from the microphone region 466*b* may be used for feedforward noise cancellation of ambient sound to improve the sound quality of the audio provided to the user. For example, the captured sound may include noise (e.g., undesirable sound) from the local area and used to adjust transducer instructions provided to the transducer section 410 to generate a sound pressure wave to cancel the noise in the local area. The sound captured from the microphone region 466*b* may be used to enable a "hear-through" experience to filter out some but not all sound around the user. The microphone region 466*b* which includes one or more microphones are external microphones at the entrance of the ear canal to capture the sound traveling to the entrance of the ear canal, which can be used to preserve the natural spatial information based on the user's own head and shoulder to create a convincing "hear-through" experience.

In some embodiments, the first microphone section 460 may include a single microphone in the microphone region 466*a* to detect sound internal to the ear canal while the second microphone section 460 may include a microphone array in the microphone region 466*b* to detect sound external to the ear canal. For example, it may be useful for the second microphone region 466*b* to include an array of microphones to detect a direction of the sound that is external to the ear canal.

The microphone sections 460 can be separately manufactured using MEMS process technology, and subsequently bonded and/or packaged together with the front volume section 420, the transducer section 410, the rear volume section 430 to form a fully integrated in-ear device 400. In some embodiments, the microphone sections 460 may be manufactured with the rear volume section 430 using MEMS process technology, and subsequently bonded and/or packaged together with the front volume section 420 and the transducer section 410. In some embodiments, the one or more sides 462 of the microphone sections 460 may be separately manufactured or fabricated on the same MEMS silicon chip or using printed circuit board (PCB) technology or other packaging technology, the microphone and/or microphone array may be separately manufactured using MEMS process technology, and then bonded and/or packaged with the front volume section 420, the transducer section 410, and the rear volume section 430.

In-Ear Device System

Figure 5A:
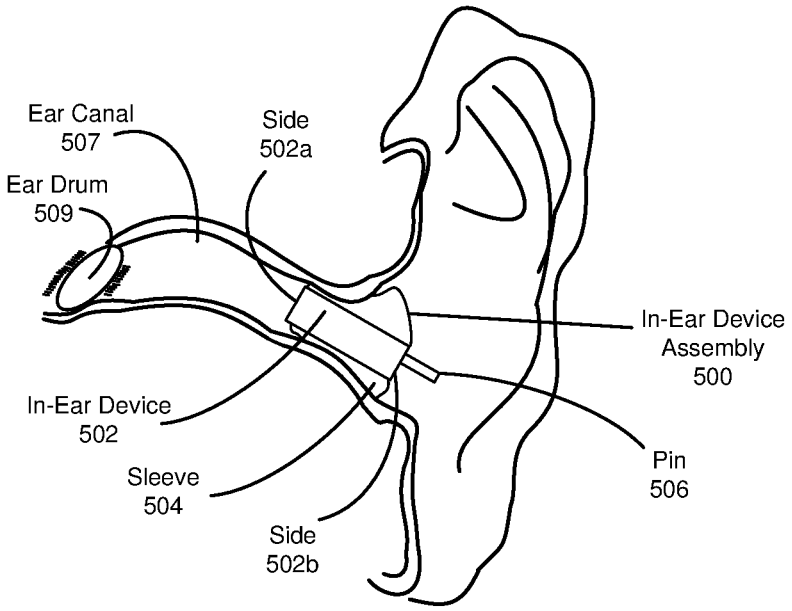
FIG. 5A is an example of an in-ear device assembly in an ear of a user, in accordance with one or more embodiments.

FIG. 5A is an example of an in-ear device assembly 500 in an ear of a user, in accordance with one or more embodiments. The in-ear device assembly 500 includes an in-ear device 502, a sleeve 504, and a pin 506. The in-ear device 502 may be a similar embodiment to the in-ear device 100, in-ear device 300, in-ear device 400, in-ear device 500, a combination or different embodiment of the in-ear devices that were previously mentioned.

The sleeve 504 is configured to be coupled to the in-ear device 502. The sleeve 504 may also be referred to as an eartip. The sleeve 504 may be made of silicone, plastic, rubber, polymer, foam, fabric, etc. or some combination thereof. The in-ear device 502 may be removable from the sleeve 504. An interior dimension of the sleeve 504 corresponds to an exterior dimension of the in-ear device 502. An exterior dimension of the sleeve 504 corresponds to a width of the ear canal 507. In some embodiments, there may be a plurality of sleeves that can couple to the in-ear device 502, the interior dimension being a same size to couple to the in-ear device 502, and the exterior dimension of each sleeve being a different size to provide a better fit for different sized ear canals. When the in-ear device assembly 500 is inserted into the ear canal 507, the sleeve 504 can provide a close seal to the ear canal 507. The sleeve 504 may cover only sides of the in-ear device 502 that are adjacent to the ear canal 507. A side 502*a* of the in-ear device 502 including an aperture in a front volume section of the in-ear device 502 may be left uncovered by the sleeve 504 to allow sound produced by the in-ear device 502 to be provided via the ear canal 507 towards the ear drum 508 of the user. The in-ear device 502 may include a microphone region on side 502*a* which is left uncovered by the sleeve 504 to allow sound internal to the ear canal 507 to reach the microphone region. The in-ear device 502 may include a microphone region on side 502*b* which is left uncovered by the sleeve 504 so that sound external to the ear canal 507 of the user may reach the microphone region. The in-ear device 502 may include a rear port with resistive mesh on side 502*b* which is left uncovered to the local area external to the ear canal.

The pin 506 is coupled to the in-ear device 502 and to enable a user to extract the in-ear device 502 from the ear canal 507. The user may hold onto the pin 506 to insert the in-ear device 502 into the ear canal 507 or remove the in-ear device 502 from the ear canal 507. The pin 506 may be flexible, comfortable, and easy to handle. The pin 506 may be coupled to the in-ear device 502. In other embodiments, the pin 506 may be coupled to the sleeve 504 of the in-ear device, or the pin 506 may be coupled to both the sleeve 504 and the in-ear device 502. In some embodiments, there may not be a pin 506, and the user may extract the in-ear device 502 by handling the sleeve 504.

Figure 5B:
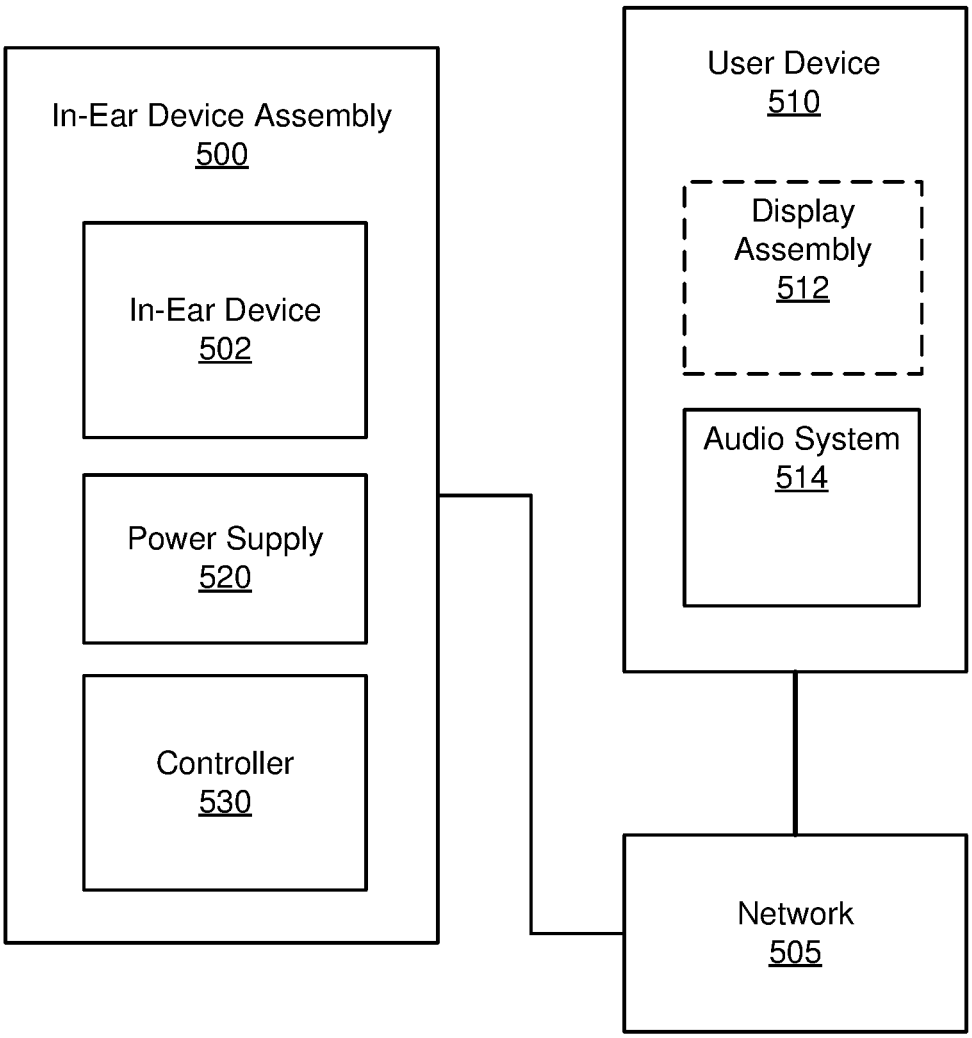
FIG. 5B is an example system diagram including the in-ear device assembly of FIG. 5A, in accordance with one or more embodiments.

FIG. 5B is an example system diagram including the in-ear device assembly 500 of FIG. 5A, in accordance with one or more embodiments. In the example shown in FIG. 5B, the system includes an in-ear device assembly 500, a network 505, and a user device 510. The network 505 connects the in-ear device assembly 500 to the user device 510. The network 505 may include any combination of local area and/or wide area networks using both wireless and/or wired communication systems. In one embodiment, the network 505 uses standard communications technologies and/or protocols. The network 505 may allow wireless transmission of signals via Radio Frequency (RF), BLUETOOTH, WIFI, some other communication methodology, or some combination thereof. While FIG. 5 shows an example system including one in-ear device assembly 500 and one network 505, in other embodiments any number of these components may be included in the system 500. For example, there may be multiple in-ear device assemblies 500 each having an associated network 505 with each in-ear device assembly 500 and network 505 communicating with the user device 510. In alternative configurations, different and/or additional components may be included in the system 500. Additionally, functionality described in conjunction with one or more of the components shown in FIG. 5B may be distributed among the components in a different manner than described in conjunction with FIG. 5B in some embodiments.

The user device 510 includes an audio system 514. The user device 510 can be a music player, a cell phone, a laptop, a headset (e.g., head mounted display, near-eye display, eyeglasses), or any personal device of the user. In some embodiments, the user device 510 may additionally include a display assembly 512. When the user device 510 is an artificial reality headset, the system may operate in a VR, AR, or MR environment, or some combination thereof. The artificial headset may present content to a user comprising augmented views of a physical, real-world environment with computer-generated elements (e.g., two dimensional (2D) or three dimensional (3D) images, 2D or 3D video, sound, etc.).

The display assembly 512 is configured to display information to the user. In various embodiments, the display assembly 512 is an electronic display. The electronic display may be a single electronic display or multiple electronic displays (e.g., for a head-mounted display, a display for each eye of a user). Examples of the electronic display include: a liquid crystal display (LCD), an organic light emitting diode (OLED) display, an active-matrix organic light-emitting diode display (AMOLED), some other display, or some combination thereof. In some embodiments, the display assembly 512 is optional.

The audio system 514 is configured to provide audio content to the user. The user device 510 may provide the audio content to the user by sending the audio content to an in-ear device 500 via the network 505. The audio system 514 may provide instructions for the in-ear device to increase or decrease a volume for the audio content. The audio system 514 may provide instructions for the in-ear device to adjust for a gain in the microphones based on feedback data received from the in-ear device. The audio system 514 may adjust an audio signal based on information received from a microphone in the ear canal of the user to make it match a target waveform, and/or from information received from a microphone external to the ear canal of the user to provide for noise cancellation.

The in-ear device assembly 500 includes the in-ear device 502, a power supply 520, and a controller 530. The in-ear device 502 includes one or more transducer sections including piezoelectric actuators, a front volume section, and one or more rear volume sections that operate as a speaker, and optionally includes one or more microphone sections to detect sound internal/external to the ear canal of the user. The power supply 520 provides power to the in-ear device 502 which is used to activate the piezoelectric actuators of the transducer section. The controller 530 provides transducer instructions to the transducer section of the in-ear device 500 to produce sound. In some embodiments, the controller 530 receives audio content and/or instructions from the user device 510 via the network 505 and generates transducer instructions based on the audio content and/or instructions. In other embodiments, the controller 530 receives transducer instructions via the network 505 generated from an audio system 514 of the user device 510 and provides the received transducer instructions to the transducer section of the in-ear device 500 to produce sound. The transducer instructions may include a content signal (e.g., electrical signal applied to the transducer section to produce sound), a control signal to enable or disable the in-ear device, and a gain signal to scale the content signal (e.g., increase or decrease the sound produced by the transducer section). The controller 530 may also receive microphone instructions via the network 505, and the controller 530 may provide the microphone instructions to one or more microphone sections to adjust for a gain based on feedback data received from the in-ear device 502.

In-Ear Device with a Transducer Section with Slits

Figure 6A:
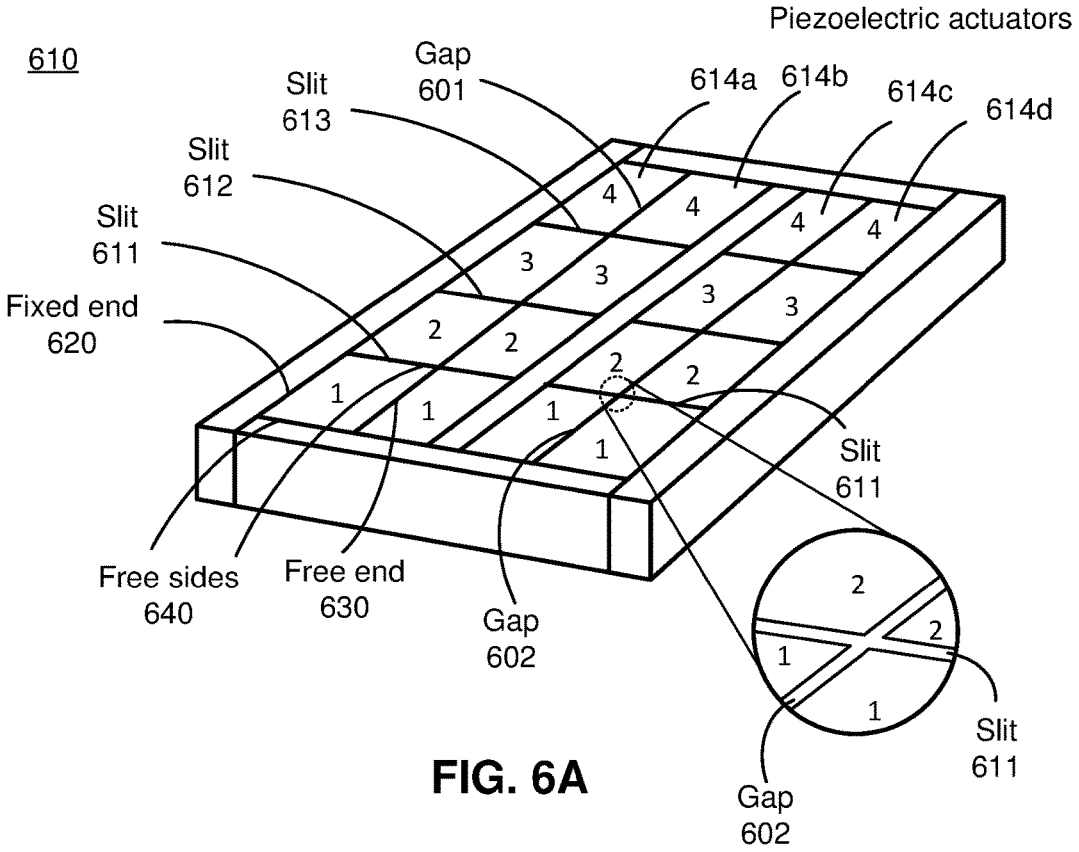
FIG. 6A is an example of an isometric view of a transducer section with slits in single end clamped piezoelectric actuators of an in-ear device in a first position, in accordance with one or more embodiments.

FIG. 6A is an example of an isometric view of a transducer section 610 with slits in single end clamped piezoelectric actuators of an in-ear device in a first position, in accordance with one or more embodiments. The transducer section 610 is similar to the transducer section 110 of FIGS. 1A-D except that there are slits made in the piezoelectric actuators 114*a-d*. A gap 601 separates piezoelectric actuators 614*a* and 614*b*, and a gap 602 separates piezoelectric actuators 614*c* and 614*d*. Each of the piezoelectric actuators 614*a-d* have slits 611, 612, and 613 (e.g., along the x-direction) to produce four flaps 1, 2, 3, and 4 or sixteen piezoelectric actuators 614*a*1-4, 614*b*1-4, 614*c*1-4, and 614*d*1-4. Each flap has a single clamped end (e.g., fixed end), a free end, and two free sides. For example, piezoelectric actuator 614*a*1 has a fixed end 620, a free end 630, and two free sides 640. The sixteen piezoelectric actuators 614*a*1-4, 614*b*1-4, 614*c*1-4, and 614*d*1-4 move together (in phase) to generate the acoustic pressure wave. In other embodiments, there could be a different number of piezoelectric actuators 614. In some embodiments, some or all of the piezoelectric actuators 614*a*1-4, 614*b*1-4, 614*c*1-4, and 614*d*1-4 (e.g., piezoelectric actuator 614*a*1, 614*a*2, 614*a*3,

614*a*4, 614*b*1, 614*b*2, . . . ) may be actuated independently. Accordingly, an amount of displacement may vary as a function of time for different free ends. For example, at a same time value, an amount of displacement of the free end 630 of the piezoelectric actuator 614*a*1 may be different than an amount of displacement of the piezoelectric actuator 614*b*1. Also as example, at a same time value, an amount of displacement of the free end 630 of the piezoelectric actuator 614*a*1 may be different than an amount of displacement of the piezoelectric actuator 614*a*2.

When depositing a piezoelectric material (e.g., aluminum nitride AlN or scandium-doped aluminum nitride AlScN) for a piezoelectric layer of the transducer section, residual stress (ranging from 10 MPa to 1 GPa) can be introduced. Residual stress may lower the sensitivity and increase the resonance frequency of the piezoelectric actuators, and may make the piezoelectric actuators to be more fragile and cause it to break. The mitigation of the residual stress is desired to protect the piezoelectric actuators and to increase the sensitivity of the piezoelectric actuators. One way to mitigate the residual stress is to introduce slits in the piezoelectric layer (e.g., creating slits in each of the piezoelectric actuators 114*a-d* of FIGS. 1A-D) to produce a plurality of flaps (e.g., flaps 1-4 of each piezoelectric actuators 614*a-d*, or piezoelectric actuators 614*a*1-4, 614*b*1-4, 614*c*1-4, and 614*d*1-4 of FIGS. 6A-B). The slits can create a gap to allow the air to flow back and forth, which may reduce the acoustic output of the piezoelectric actuators 614*a-d* from the piezoelectric actuators 114*a-d* in the low frequency range.

Figure 6B:
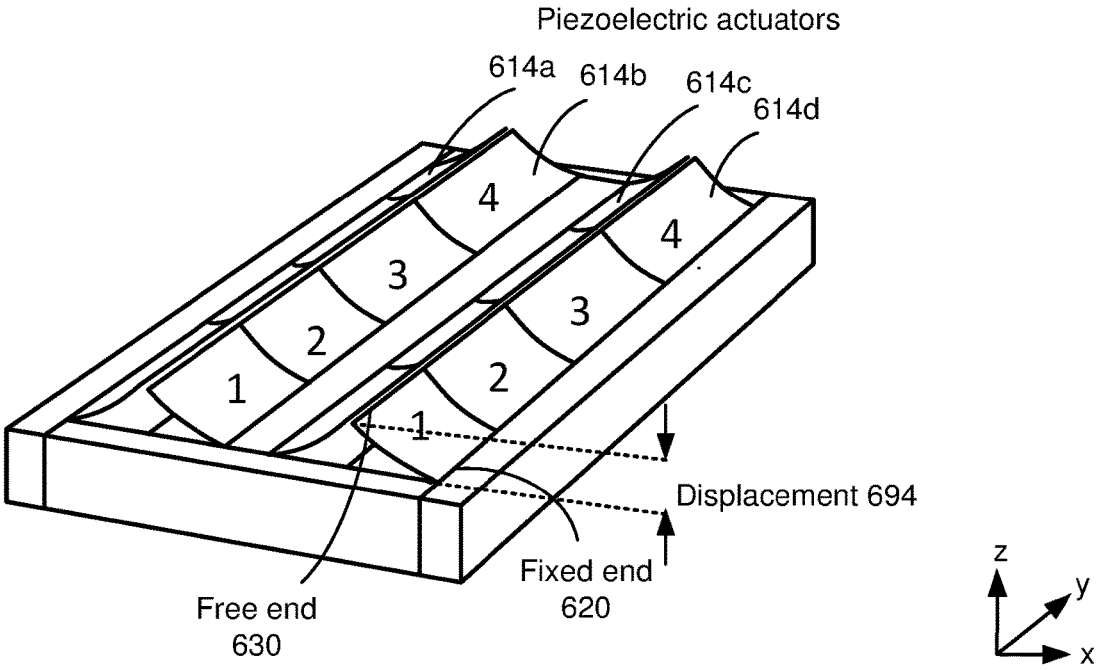
FIG. 6B is an example of an isometric view of the transducer section of FIG. 6A in a second position, in accordance with one or more embodiments.

FIG. 6B is an example of an isometric view of the transducer section of FIG. 6A in a second position, in accordance with one or more embodiments. In the second position, a height of a free end (e.g., the free end 620 of flap 1 of the piezoelectric actuator 614*d*) of a piezoelectric actuator has a displacement 694 relative to a height of a fixed end of the piezoelectric actuator (e.g., the fixed end 630 of flap 1 of the piezoelectric actuator 614*d*).

FIG. 7A is an example of an isometric view of a transducer section 710 with slits in double end clamped piezoelectric actuators of an in-ear device in a first position, in accordance with one or more embodiments. The transducer section 710 is similar to the transducer section 110 of FIGS. 1A-D except that there is no gap between the first pair of piezoelectric actuators 114*a-b*, and the second pair of piezoelectric actuators 114*c-d* and there are slits made in the piezoelectric actuators 114*a-b*, and 114*c-d*. Because both ends of the piezoelectric actuators 714*a* and 714*b* are clamped, displacement occurs in a central portion of the piezoelectric actuators 714*a* and 714*b* which is allowed to move, as opposed to the clamped ends of 714*a* and 714*b*. Each of the piezoelectric actuators 714*a* and 714*b* include a plurality of slits 711, 712, and 713 to produce four sections 1, 2, 3, and 4 that each have two clamped ends (fixed ends) and two free sides (e.g., eight piezoelectric actuators 714*a*1-4 and 714*b*1-4). For example, piezoelectric actuator 714*a*1 has two fixed ends 720 and two free sides 730. The eight piezoelectric actuators 714*a*1-4 and 714*b*1-4 move together (in phase) to generate the acoustic pressure wave. In other embodiments, there could be a different number of piezoelectric actuators 714. In some embodiments, some or all of the piezoelectric actuators 714*a*1-4 and 714*b*1-4 (e.g., piezoelectric actuators 714*a*1, 714*a*2, 714*a*3, 714*a*4, 714*b*1, 714*b*2, 714*b*3, 714*b*4) may be actuated independently. Accordingly, an amount of displacement may vary as a function of time for different free sides. For example, at a same time value, an amount of displacement of the free sides 730 of the piezoelectric actuator 714*a*1 may be different than an amount of displacement of the piezoelectric actuator 714*b*1. Also as example, at a same time value, an amount of displacement of the free sides 730 of the piezoelectric actuator 714*a*1 may be different than an amount of displacement of the piezoelectric actuator 714*a*2.

FIG. 7B is an example of an isometric view of the transducer section of FIG. 7A in a second position, in accordance with one or more embodiments. In the second position, a height of the free side (e.g., the free side 730 of the piezoelectric actuator 714*b*1) of a piezoelectric actuator has a displacement 794 relative to a height of a fixed end of the piezoelectric actuator (e.g., the fixed end 720 of piezoelectric actuator 714*b*1).

Fabrication Process of In-Ear Device

The example fabrication process described below regarding FIGS. 8A-G, FIGS. 9A-B and FIG. 10 can be performed by a manufacturing system. The manufacturing system is configured to perform the processing steps described below regarding FIGS. 8A-G, FIGS. 9A-B and FIG. 10, or some combination thereof. The manufacturing system includes a lithography tool, a piezoelectric material deposition tool (e.g., sputter deposition tool), a metal deposition tool (e.g., electron-beam physical vapor deposition tool, thermal evaporator, sputter deposition tool, etc.), a dry etching tool (e.g., plasma etching system, glass etcher, deep reactive ion etcher (DRIE), etc.), a wet bench tool (e.g., for performing wet cleaning, etching operations, etc.), a bonding tool (e.g., wafer bonder), or some combination thereof. The manufacturing system can perform a deposition and patterning of a photoresist, metal, and/or piezoelectric film. The manufacturing system can perform an etching or partial etching of substrates such as a silicon wafer or a silicon oxide layer. The manufacturing system can bond substrates that are separately manufactured using MEMS process technology together.

FIGS. 8A-G is an example fabrication process of a transducer section of an in-ear device, in accordance with one or more embodiments. This example is merely illustrative, and other processes may be used to form the transducer section of the in-ear device. Likewise, embodiments may include different and/or additional steps, or may perform the steps in different orders.

Figure 8A:
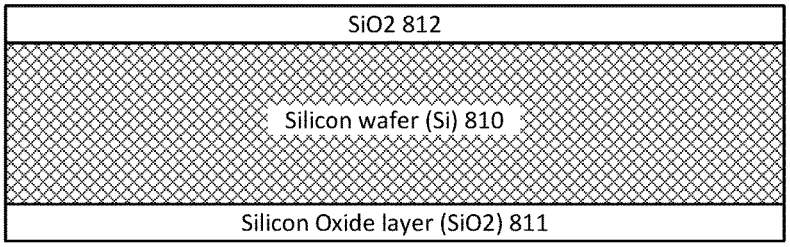
FIGS. 8A-G is an example fabrication process of a transducer section of an in-ear device, in accordance with one or more embodiments.

FIG. 8A is an example substrate made of a silicon (Si) wafer 810 and silicon oxide (SiO2) layers 811 and 812. A first silicon oxide layer 811 is on one side (e.g., backside) of the silicon wafer 810, and a second silicon oxide layer 812 on an opposite side (e.g., frontside) of the silicon wafer 810.

Figure 8B:
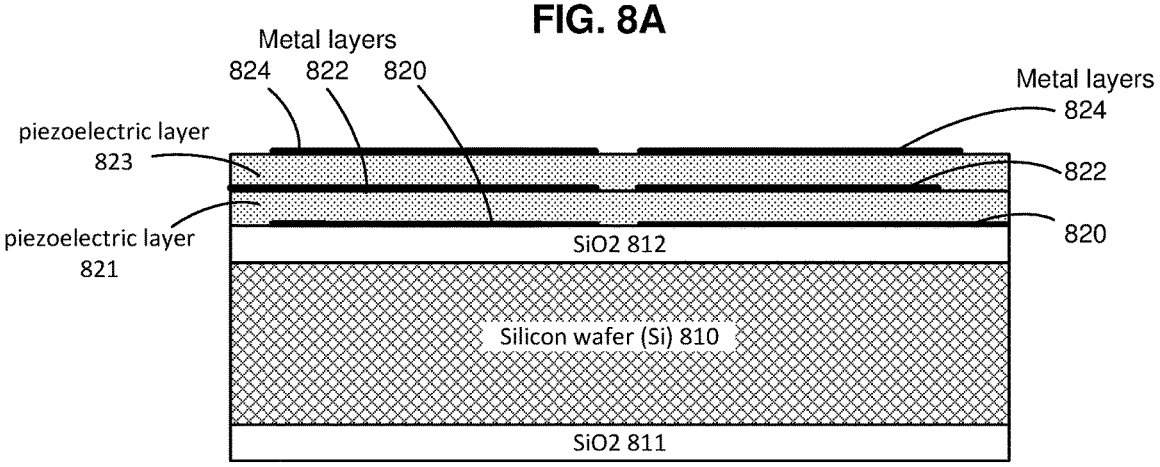

FIG. 8B is an example of a first metal layer 820, a first piezoelectric layer 821, a second metal layer 822, a second piezoelectric layer 823, and a third metal layer 824 on the second silicon oxide layer 812 (e.g., front side of the substrate). The metal layers 820, 822, 824 may be made of platinum (Pt) or molybdenum (Mo) material, and the piezoelectric layers 821 and 823 may be made aluminum nitride (AlN) material. A first metal layer 820 is deposited/patterned on the second silicon oxide layer 812. A first mask may be used to pattern the first metal layer 820 using standard lithography tools and a wet bench. For example, the first mask may be a photomask used to create a patterned layer of photoresist on silicon oxide layer 812, the first metal layer 820 is deposited on the patterned layer of photoresist, and the patterned layer of photoresist is removed in a lift-off process to pattern the metal layer 820. As another example, the first metal layer 820 may be deposited on the silicon oxide layer 812, and a patterned layer of photoresist may deposited on the first metal layer 820 to be used as an etch mask, and the patterned layer of photoresist may be removed after etching the metal layer 820. A first piezoelectric layer 821 is deposited on the patterned first metal layer 820. A second metal layer 822 is deposited/patterned on the first piezoelectric layer 821 using a similar process as the patterning of the first metal layer 820 but with a second mask. A second piezoelectric layer 823 is deposited on the second metal layer 822. A third metal layer 824 is deposited/patterned on the first piezoelectric layer 823 using a similar process as the patterning of the first metal layer 820 but with a third mask.

Figure 8C:
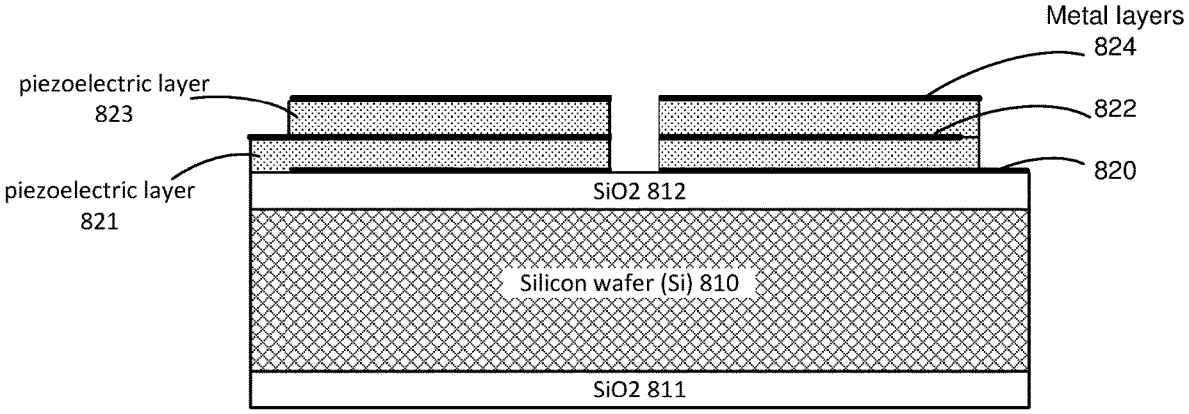

FIG. 8C is an example of patterning the first piezoelectric layer 821 and the second piezoelectric layer 823. A fourth mask and a fifth mask may be used to create vias to metal layers 820 and 822 respectively. A sixth mask may be used to pattern the piezoelectric layers.

Figure 8D:
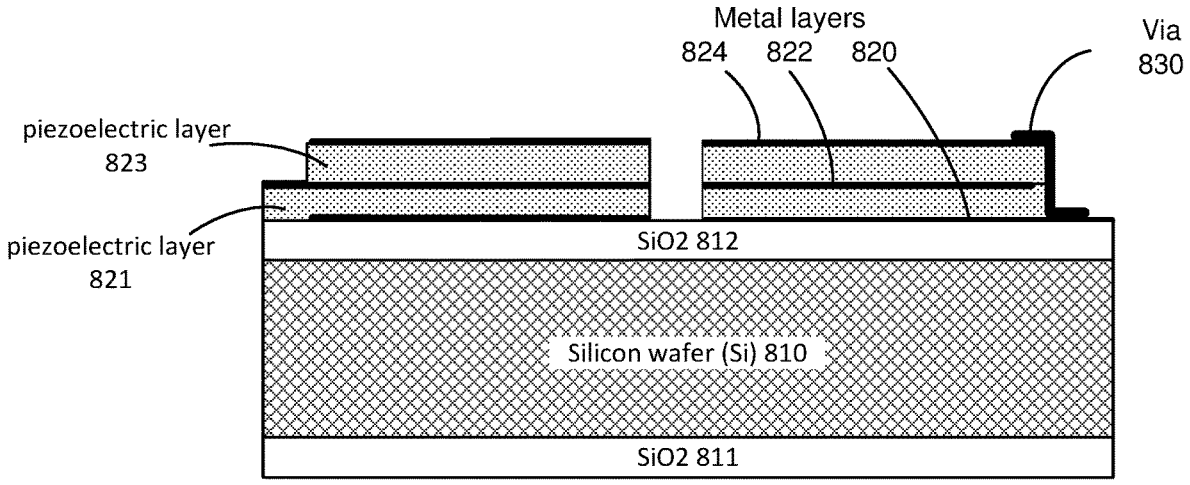

FIG. 8D is an example of depositing/patterning a via 830 to provide an electrical connection to a first metal layer 820. In this example, the via 830 connects the first metal layer 820 to the third metal layer 824. The via 830 may also connect the first metal layer 820 to an electrode A fourth mask may be used to patterning the via 830. Another via is also deposited/patterned to provide an electrical connection to the second metal layer 822. A fifth mask may be used to pattern the via connecting to the second metal layer 822.

Electrode pads are also patterned/deposited and may be made of a gold (Au) material. A seventh mask may be used to the pattern the electrode pads, and the electrode pads may be connected to corresponding metal layers through electrical traces and the vias.

Figure 8E:
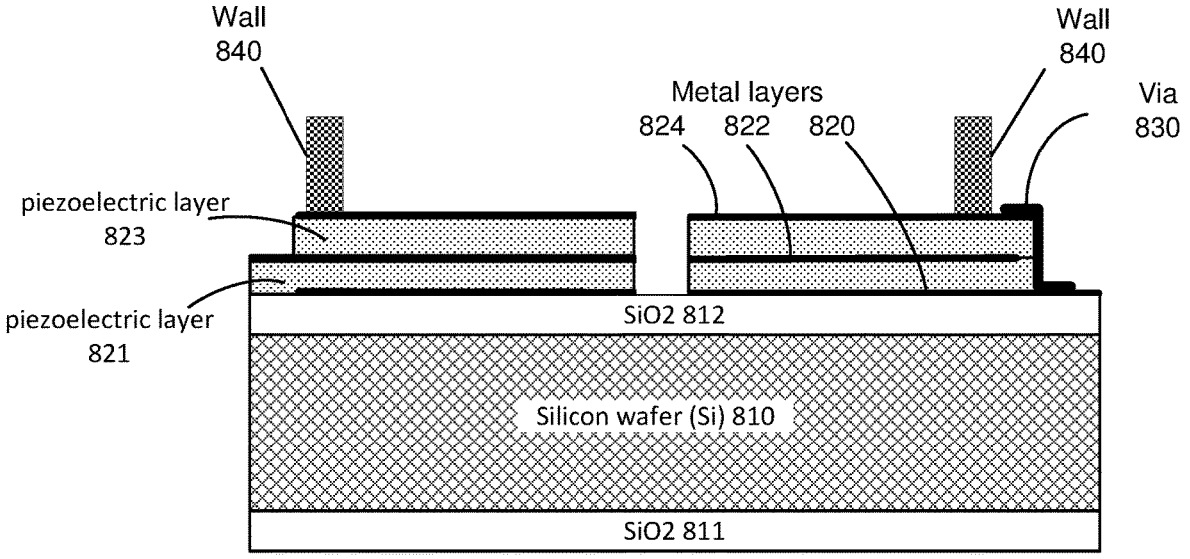

FIG. 8E shows the deposition of two walls 840 on the third metal layer 824. When piezoelectric actuators of a transducer section of an in-ear device are actuated, the walls 840 can ensure that the displacement in the free sides and/or free end of the piezoelectric actuators are not causing too much air to travel back and forth, which can cause acoustic cancellation.

Figure 8F:
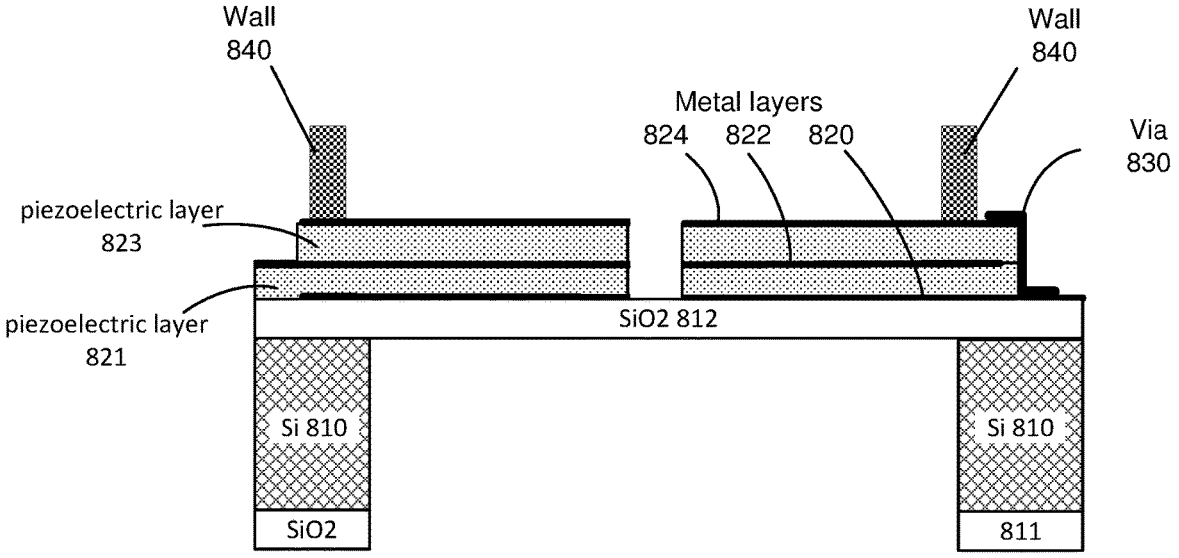

FIG. 8F shows a backside deep reactive ion etching (DRIE) to pattern the silicon oxide layer 811 and the silicon wafer 810. The silicon oxide layer 811 and the silicon wafer 810 is patterned and completely removed in some areas. An eighth mask may be used for this step.

Figure 8G:
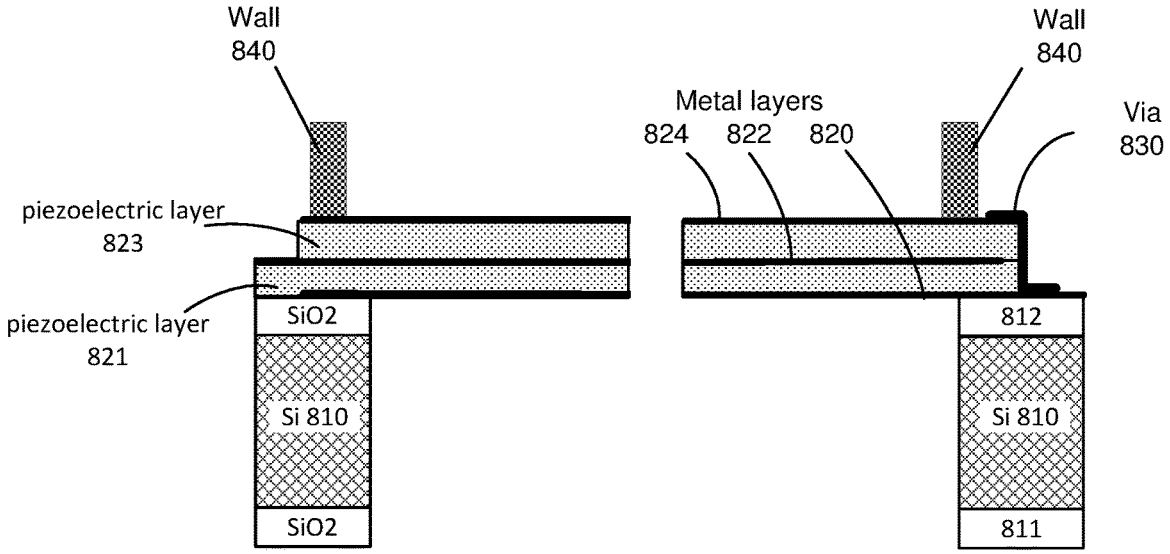

FIG. 8G shows a backside DRIE to pattern the silicon oxide layer 812 to produce a transducer section of the in-ear device, in accordance with one or more embodiments. The silicon oxide layer 812 is patterned and completely removed in some areas. An eighth mask (same mask as for FIG. 8F) can be used for this step.

The transducer section shown in FIG. 8G is similar to a transducer section 110 as shown in FIGS. 1A-D except that the transducer section 110 includes two pairs of piezoelectric actuators (e.g., piezoelectric actuators 114*a,b* and piezoelectric actuators 114*c,d*) instead of one pair of piezoelectric actuators (e.g.,) as shown in FIG. 8G. In another embodiment, two or more pairs of piezoelectric actuators, or a different number (one or more piezoelectric actuators) can be produced using a similar process of FIGS. 8A-G with a different set of masks. The frame 112 of the transducer section in FIG. 1A-D corresponds to the silicon wafer 810, the silicon oxide layer 811, and the silicon oxide layer 812 shown in FIG. 8G. While the transducer section of FIG. 8G shows the piezoelectric layer 821 and metal layer 820 extending to one edge and metal layer 822 extending to another edge of the substrate, in another embodiment the piezoelectric layer 821 and the metal layers 820 and 822 can be patterned so that portion of the frontside of the substrate (e.g., silicon oxide layer 812) are exposed at the edges of the substrate.

Figure 9A:
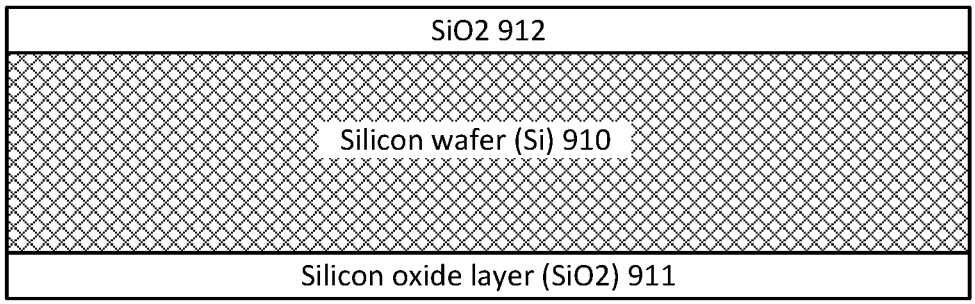
FIGS. 9A-B is an example fabrication process of a front volume section or a rear volume section of an in-ear device, in accordance with one or more embodiments
Figure 9B:
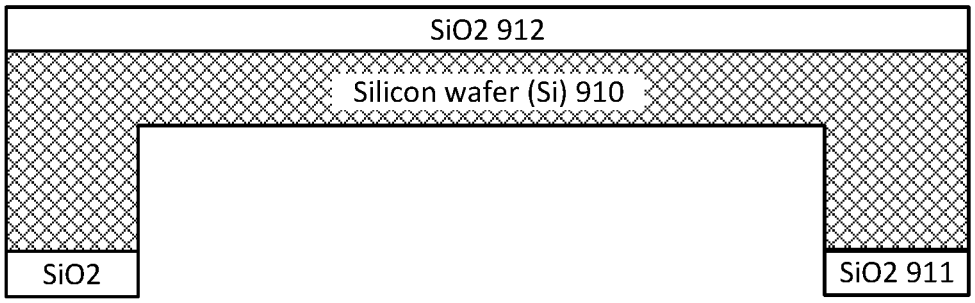

FIGS. 9A-B is an example fabrication process of a front volume section or a rear volume section of an in-ear device, in accordance with one or more embodiments. This example is merely illustrative, and other processes may be used to form the front volume section or the rear volume section of the in-ear device. Likewise, embodiments may include different and/or additional steps, or may perform the steps in different orders.

FIG. 9A is an example substrate made of a silicon wafer 910 and silicon oxide layers 911 and 912. A first silicon oxide layer 911 is on one side (e.g., backside) of the silicon wafer 910, and a second silicon oxide layer 912 on an opposite side (e.g., frontside) of the silicon wafer 910.

FIG. 9B shows a cavity etched into the example substrate of FIG. 9A by patterning the silicon oxide layer 911 and the silicon wafer 910 using backside DRIE. The silicon oxide layer 911 is patterned and completely removed in some areas. The silicon wafer 910 is partially patterned (e.g., partially removed) in some areas. A ninth mask may be used for this step.

The example substrate with the etched cavity in FIG. 9B is similar to a front volume section 120 or a rear volume section 130 as shown in FIGS. 1A-B. The cavity shown in FIG. 9B can correspond to a front cavity 150 or a rear cavity 152 as shown in FIG. 1B.

Figure 10:
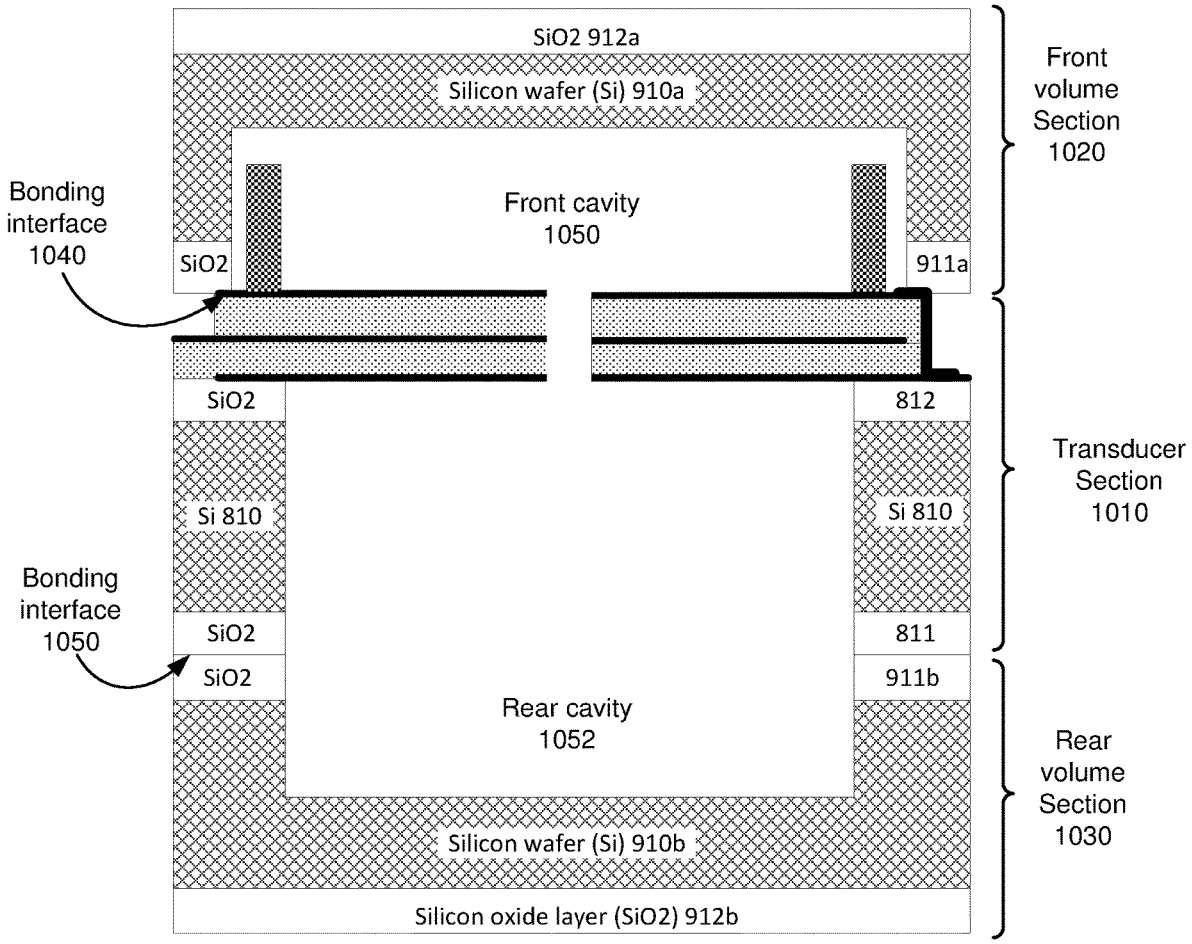
FIG. 10 is an example bonding process of the transducer section of FIG. 8G to a front volume section and a rear volume section of an in-ear device, in accordance with one or more embodiments.

FIG. 10 is an example bonding process of the transducer section 1010 of FIG. 8G to a front volume section 1020 and a rear volume section 1030 of an in-ear device, in accordance with one or more embodiments. The front volume section 1020 and the rear volume section 1030 are similar to the example substrate with the etched cavity in FIG. 9B, except that they may have different dimensions. The transducer section 1010 is the same as the transducer section of FIG. 8G. The front volume section 1020 includes a partially patterned silicon wafer 910*a*, a first layer of patterned silicon oxide 911*a*, and a second layer of silicon oxide 912*a*. The rear volume section 1030 includes a partially patterned silicon wafer 910*b*, a first layer of patterned silicon oxide 911*b*, and a second layer of silicon oxide 912*b*. The front volume section 1020 is bonded to the transducer section 1010 at a bonding interface 1040. The rear volume section 1030 is bonded to the transducer section 1010 at a bonding interface 1050.

The in-ear device shown in FIG. 10 is similar to the in-ear device 100 of FIGS. 1A-B except that only a single pair of actuators are shown in the transducer section 1010, while the transducer section 110 shows two pairs of piezoelectric actuators 114. In another embodiment, the transducer section 1010 may include two or more pairs of piezoelectric actuators, or a different number (one or more piezoelectric actuators). The front volume section 1020 and front cavity 1050 is substantially similar to the front volume section 120 and the front cavity 150 of FIGS. 1A-B, and the rear volume section 1030 and the rear cavity 1052 is substantially similar to the rear volume section 130 and the rear cavity 152 of FIGS. 1A-B. While FIG. 10 shows the bonding interface 1040 being the silicon oxide layer 911*a* attached to a metal layer (e.g., metal layer 824 or via 830), in another embodiment the bonding interface 1040 may be the silicon oxide layer 911*a* to the silicon oxide layer 812 (e.g., piezoelectric actuators are shifted so that a portion of the underlying silicon oxide layer 812 is exposed).

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An in-ear device comprising:

a transducer section including a frame and a plurality of piezoelectric actuators coupled to the frame, the plurality of the piezoelectric actuators configured to generate an acoustic pressure wave, the transducer section including a first side and a second side, the second side being opposite the first side;

a front volume section coupled to the first side to form a front cavity, the front volume section including an aperture from which the generated acoustic pressure wave exits the front volume section towards an ear drum of a user;

a rear volume section coupled to the second side to form a rear cavity, wherein the transducer section, the front volume section, and the rear volume section are configured to fit entirely within an ear canal of the user; and a microphone section comprising one or more sides configured to be coupled to a side of the rear volume section to form a microphone cavity, the microphone section further comprising a microphone region including one or more microphones and a microphone aperture through which sound passes to the one or more microphones, the microphone section being on a same side of the in-ear device as the aperture, the one or more microphones configured to capture sound internal to the ear canal.

2. The in-ear device of claim 1, further comprising:

a second transducer section including a second frame and a plurality of second piezoelectric actuators coupled to the second frame, the plurality of the second piezoelectric actuators configured to generate a second acoustic pressure wave, the second transducer section including a third side and a fourth side, the third side being opposite the fourth side, and wherein the front cavity is further formed in part by the front volume section being coupled to the third side of the second transducer assembly, and the second acoustic pressure wave exits the front volume section via the aperture towards the ear drum of the user.

3. The in-ear device of claim 2, further comprising:

a second rear volume section coupled to the fourth side of the second transducer section to form a second rear cavity.

4. An in-ear device comprising:

a transducer section including a frame and a plurality of piezoelectric actuators coupled to the frame, the plurality of the piezoelectric actuators configured to generate an acoustic pressure wave, the transducer section including a first side and a second side, the second side being opposite the first side;

a front volume section coupled to the first side to form a front cavity, the front volume section including an aperture from which the generated acoustic pressure wave exits the front volume section towards an ear drum of a user;

a rear volume section coupled to the second side to form a rear cavity, wherein the transducer section, the front volume section, and the rear volume section are configured to fit entirely within an ear canal of the user; and a microphone section comprising one or more sides configured to be coupled to a side of the rear volume section to form a microphone cavity, the microphone section further comprising a microphone region including one or more microphones and a microphone aperture through which sound passes to the microphone, the microphone section being on an opposite side of the in-ear device as the aperture, the one or more microphones configured to capture sound from a local area external to the ear canal.

5. The in-ear device of claim 4, wherein the microphone section further comprises a mesh that covers the microphone aperture of the microphone section.

6. The in-ear device of claim 1, wherein the front volume section further comprises a mesh that covers the aperture.

7. The in-ear device of claim 1, wherein each of the piezoelectric actuators includes a first end and a second end opposite the first end, the first end being attached to the frame, wherein a length of the piezoelectric actuators corresponds to a distance between the first end and the second end, a width of the piezoelectric actuators corresponds to a distance across the second end in a dimension in-line with the ear canal, the width being larger than the length.

8. The in-ear device of claim 1, wherein the plurality of the piezoelectric actuators includes a first pair of the piezoelectric actuators including a first piezoelectric actuator and a second piezoelectric actuator, and a second pair of the piezoelectric actuators including a third piezoelectric actuator and a fourth piezoelectric actuator.

9. The in-ear device of claim 8, wherein the frame includes a first section corresponding to an interior portion of the frame and a second section corresponding to an exterior portion of the frame, wherein the plurality of the piezoelectric actuators are surrounded by the first section of the frame, and the first pair of the piezoelectric actuators and the second pair of the piezoelectric actuators separated by the second section of the frame.

10. The in-ear device of claim 9, wherein each of the piezoelectric actuators of the plurality of piezoelectric actuators includes a first end and a second end opposite the first end, the first piezoelectric actuator and the fourth piezoelectric actuator are coupled to the first section of the frame via a corresponding first end, and the second piezoelectric actuator and the third piezoelectric actuator are coupled to the second section of the frame via a corresponding first end.

11. The in-ear device of claim 10, wherein the first piezoelectric actuator and the fourth piezoelectric actuator are coupled to the first section of the frame, and the second piezoelectric actuator and the third piezoelectric actuator are coupled to the second section of the frame.

12. The in-ear device of claim 10, wherein the second end of the first piezoelectric actuator and the second end of the second piezoelectric actuator face each other, and wherein the second end of the third piezoelectric actuator and the second end of the fourth piezoelectric actuator face each other.

13. The in-ear device of claim 10, wherein responsive to the plurality of piezoelectric actuators being activated, a corresponding second end is displaced in a direction towards the front volume section.

14. The in-ear device of claim 1, wherein one of the piezoelectric actuators is a bimorph comprising a first piezoelectric layer and a second piezoelectric layer, the first piezoelectric layer configured to expand and the second piezoelectric layer configured to contract responsive to a voltage being applied to the bimorph.

15. The in-ear device of claim 1, wherein one of the piezoelectric actuators has a resonance frequency above 20 kHz.

16. The in-ear device of claim 1, wherein a volume of the rear volume section is larger than a volume of the front volume section.

17. The in-ear device of claim 1, wherein the rear cavity is filled with acoustic material to increase an effective acoustic volume.

18. The in-ear device of claim 1, wherein the in-ear device is configured to be coupled to a sleeve, wherein the sleeve can provide a seal between the ear canal and the sleeve.

19. The in-ear device of claim 4, further comprising:

a first microphone section comprising one or more sides configured to be coupled to a side of the rear volume section to form a microphone cavity, the first microphone section further comprising a first microphone region including one or more first microphones and a first aperture through which sound passes to the one or more first microphones, the first microphone section being on a same side of the in-ear device as the aperture, the one or more first microphones configured to capture sound internal to the ear canal; and a second microphone section configured to be coupled to another side of the rear volume section to form a second side cavity, the second microphone section comprising a second microphone region including one or more second microphones and a second aperture through which sound passes to the one or more second microphones, the second microphone section being on an opposite side of the in-ear device as the aperture, the one or more second microphones configured to capture sound from a local area external to the ear canal.

20. An in-ear device comprising:

a transducer section including a frame and a plurality of piezoelectric actuators coupled to the frame, the plurality of the piezoelectric actuators configured to generate an acoustic pressure wave, the plurality of the piezoelectric actuators include a first pair of the piezoelectric actuators including a first piezoelectric actuator and a second piezoelectric actuator, and a second pair of the piezoelectric actuators including a third piezoelectric actuator and a fourth piezoelectric actuator, and the transducer section including a first side and a second side, the second side being opposite the first side;

a front volume section coupled to the first side to form a front cavity, the front volume section including an aperture from which the generated acoustic pressure wave exits the front volume section towards an ear drum of a user; and a rear volume section coupled to the second side to form a rear cavity, wherein the transducer section, the front volume section, and the rear volume section are configured to fit entirely within an ear canal of the user, wherein the frame includes a first section corresponding to an interior portion of the frame and a second section corresponding to an exterior portion of the frame, and the plurality of the piezoelectric actuators are surrounded by the first section of the frame, and the first pair of the piezoelectric actuators and the second pair of the piezoelectric actuators are separated by the second section of the frame.

* * * * *